US008784577B2

(12) United States Patent
Kami et al.

(10) Patent No.: US 8,784,577 B2
(45) Date of Patent: Jul. 22, 2014

(54) THICK HIGH-TENSILE-STRENGTH HOT-ROLLED STEEL SHEET HAVING EXCELLENT LOW-TEMPERATURE TOUGHNESS AND MANUFACTURING METHOD THEREOF

(75) Inventors: Chikara Kami, Kurashiki (JP); Hiroshi Nakata, Kurashiki (JP); Kinya Nakagawa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/146,747

(22) PCT Filed: Jan. 29, 2010

(86) PCT No.: PCT/JP2010/051646

§ 371 (c)(1),
(2), (4) Date: Jul. 28, 2011

(87) PCT Pub. No.: WO2010/087511

PCT Pub. Date: Aug. 5, 2010

(65) Prior Publication Data

US 2011/0284137 A1 Nov. 24, 2011

(30) Foreign Application Priority Data

Jan. 30, 2009 (JP) ..... 2009-019353
Jan. 30, 2009 (JP) ..... 2009-019356
Jan. 30, 2009 (JP) ..... 2009-019357

(51) Int. Cl.

| | |
|---|---|
| ***C22C 38/02*** | (2006.01) |
| ***C22C 38/04*** | (2006.01) |
| ***C22C 38/12*** | (2006.01) |
| ***C22C 38/14*** | (2006.01) |
| ***C21D 8/02*** | (2006.01) |

(52) U.S. Cl.

USPC ..... 148/320; 148/332; 148/333; 148/334; 148/335; 148/336; 148/602; 148/654; 148/664; 148/504

(58) Field of Classification Search

USPC ..... 148/320, 332–336, 602, 654.664
See application file for complete search history.

(56) References Cited

U.S. PATENT DOCUMENTS 5,948,183 A 9/1999 Okada et al.

(Continued)

FOREIGN PATENT DOCUMENTS

JP 64-025916 1/1989
JP 04-021719 1/1992

(Continued)

OTHER PUBLICATIONS

Kami, Tsutomu et al, Machine-English Translation of Japanese patent 2005-264217, Sep. 29, 2005.*

(Continued)

*Primary Examiner* — Deborah Yee
(74) *Attorney, Agent, or Firm* — RatnerPrestia

(57) ABSTRACT

A high-tensile-strength hot-rolled steel sheet is provided having a composition which contains 0.02 to 0.08% C, 0.01 to 0.10% Nb, 0.001 to 0.05% Ti and Fe and unavoidable impurities as a balance, wherein the steel sheet contains C, Ti and Nb in such a manner that (Ti+(Nb/2))/C<4 is satisfied, and the steel sheet has a structure where a primary phase of the structure at a position 1 mm away from a surface in a sheet thickness direction is one selected from a group consisting of a ferrite phase, tempered martensite and a mixture structure of a ferrite phase and tempered martensite, a primary phase of the structure at a sheet thickness center position is formed of a ferrite phase, and a difference ΔV between a structural fraction (volume %) of a secondary phase at the position 1 mm away from the surface in the sheet thickness direction and a structural fraction (volume %) of a secondary phase at the sheet thickness center position is 2% or less.

19 Claims, 3 Drawing Sheets

(56) References Cited

U.S. PATENT DOCUMENTS

| | | | | |
|---|---|---|---|---|
| 6,695,932 | B2 | 2/2004 | Kami et al. | |
| 6,702,904 | B2 | 3/2004 | Kami et al. | |
| 6,899,771 | B2 | 5/2005 | Kami et al. | |
| 6,902,632 | B2 | 6/2005 | Kami et al. | |
| 7,101,445 | B2 | 9/2006 | Kami et al. | |
| 7,501,030 | B2 | 3/2009 | Nakata et al. | |
| 7,879,287 | B2 | 2/2011 | Kobayashi et al. | |
| 2004/0187982 | A1 | 9/2004 | Nakata et al. | |
| 2005/0183798 | A1* | 8/2005 | Kobayashi et al. | 148/593 |
| 2012/0018056 | A1 | 1/2012 | Nakagawa et al. | |

FOREIGN PATENT DOCUMENTS

| | | | |
|---|---|---|---|
| JP | 08-319538 | | 12/1996 |
| JP | 09-296216 | | 11/1997 |
| JP | 11-080833 | | 3/1999 |
| JP | 2000-160245 | A | 6/2000 |
| JP | 2001-240936 | | 9/2001 |
| JP | 2001-286927 | A | 10/2001 |
| JP | 2004-315957 | | 11/2004 |
| JP | 2004315957 | | 11/2004 |
| JP | 2005-240051 | A | 9/2005 |
| JP | 2005281838 | | 10/2005 |
| JP | 2006-299415 | A | 11/2006 |
| JP | 2007138290 | | 6/2007 |
| JP | 2008-056962 | | 3/2008 |
| JP | 2008274323 | | 11/2008 |
| JP | 2010037567 | | 2/2010 |

OTHER PUBLICATIONS

International Search Report for PCT/JP2010/051646 dated May 11, 2010.

International Preliminary Report on Patentability and Written Opinion mailed Mar. 17, 2011, application No. PCT/3P2009/063981.

Supplemental European Search Report communicated Jun. 25, 2012, application No. EP 09803078.

Office Action dated Apr. 9, 2012 for U.S. Appl. No. 13/056,791, including List of Publications Cited by Applicant and Notice of References Cited.

Office Action dated Mar. 4, 2013 for U.S. Appl. No. 13/056,791, including List of Publications Cited by Applicant.

B. Mishra, "Steelmaking Practices and Their Influence on Properties", ASM Handbook, ASM International 2002, pp. 1-9.

* cited by examiner

THICK HIGH-TENSILE-STRENGTH HOT-ROLLED STEEL SHEET HAVING EXCELLENT LOW-TEMPERATURE TOUGHNESS AND MANUFACTURING METHOD THEREOF

CROSS-REFERENCE TO RELATED APPLICATIONS

This application is the U.S. National Phase application of PCT International Application No. PCT/JP2010/051646, filed Jan. 29, 2010, and claims priority to Japanese Patent Application No. 2009-019353, filed Jan. 30, 2009; Japanese Patent Application No. 2009-019356, filed Jan. 30, 2009; and Japanese Patent Application No. 2009-019357, filed Jan. 30, 2009, the disclosures of which PCT and priority applications are incorporated herein by reference in their entirely for all purposes.

FIELD OF THE INVENTION

The present invention relates to a thick high-tensile-strength hot-rolled steel sheet which is preferably used as a raw material for manufacturing a high strength electric resistance welded steel pipe or a high strength spiral steel pipe which is required to possess high toughness when used as a line pipe for transporting crude oil, a natural gas or the like and a manufacturing method thereof, and more particularly to the enhancement of low-temperature toughness. Here, "steel sheet" is a concept which includes a steel plate and a steel strip. In this specification, "high-tensile-strength hot-rolled steel sheet" means a hot-rolled steel sheet having high strength with tensile strength TS of 510 MPa or more, and "thick wall" steel sheet is a steel sheet having a sheet thickness of 11 mm or more, and also an extra thick high-tensile-strength hot-rolled steel sheet having a sheet thickness of more than 22 mm.

BACKGROUND OF THE INVENTION

Recently, in view of sharp rise of crude oil price since oil crisis, demands for versatility of sources of energy or the like, the drilling for oil and natural gas and the pipeline construction in a very cold land such as the North Sea, Canada and Alaska have been actively promoted. Further, the development of a sour gas field and the like whose development was once abandoned because of its strong corrosion has also recently been developed vigorously.

Further, here, with respect to a pipeline, there has been observed a trend where a transport operation is performed using a large-diameter pipe under a high pressure to enhance transport efficiency of natural gas or oil. To withstand a high-pressure operation in a pipeline, it is advantageous to form a transport pipe (line pipe) using a heavy wall thickness pipe so that a UOE steel pipe which is formed of a plate is used. Recently, however, there have been strong demands for the further reduction of construction cost of a pipeline or demands for the reduction of a material cost of steel pipes due to the unstable supply sufficiency of UOE steel pipes. Accordingly, as a transport pipe, in place of a UOE steel pipe which uses a plate as a raw material, a high strength electric resistance welded steel pipe or a high strength spiral steel pipe which is formed using a coil-shaped hot-rolled steel sheet (hot-rolled steel strip) which possesses high productivity and can be produced at a lower cost has been used.

These high strength steel pipes are required to possess excellent low-temperature toughness from a viewpoint of preventing bust-up of a line pipe. To manufacture such a steel pipe which possesses both of high strength and high toughness, attempts have been made to impart higher strength to a steel sheet which is a raw material of a steel pipe by transformation strengthening which makes use of accelerated cooling after hot rolling, precipitation strengthening which makes use of precipitates of alloy elements such as Nb, V, Ti or the like, and attempts have been made to impart higher toughness to the steel sheet through the formation of microstructure by making use of controlled rolling or the like.

Further, a line pipe which is used for transporting crude oil or natural gas which contains hydrogen sulfide is required to be excellent in so-called sour gas resistances such as hydrogen induced cracking resistance (HIC resistance), or stress corrosion cracking resistance in addition to properties such as high strength and high toughness.

To satisfy such a demand, patent document 1, for example, proposes a method of manufacturing a low yield ratio and high strength hot rolled steel sheet which possesses excellent toughness, wherein steel which contains 0.005 to 0.030% or less C and 0.0002 to 0.0100% B, and contains 0.20% or less Ti and 0.25% or less Nb in a state where either or both of Ti and Nb satisfy the relationship of (Ti+Nb/2)/C: 4 or more, and further contains proper amounts of Si, Mn, P, Al and N is subjected to hot rolling and, thereafter, is cooled at a cooling rate of 5 to 20° C./s, and is coiled at a temperature range from more than 550° C. to 700° C. thus manufacturing the hot rolled steel sheet in which the structure is formed of ferrite and/or bainitic ferrite, and an amount of solid solution carbon in grains is set to 1.0 to 4.0 ppm. According to the technique disclosed in patent document 1, it may be possible to manufacture a high strength hot rolled steel sheet which possesses excellent toughness, excellent weldability and excellent sour gas resistance, and also possesses a low yield ratio without causing non-uniformity of a material in the thickness direction as well as in the length direction.

However, in the technique disclosed in patent document 1, the amount of solid solution carbon in grains is 1.0 to 4.0 ppm and hence, due to charged heat at the time of performing girth weld, the growth of crystal grains is liable to occur so that a welded heat affected zone becomes coarse grains thus giving rise to a drawback that toughness of the welded heat affected zone of the girth weld portion is easily deteriorated.

Further, patent document 2 proposes a method of manufacturing a high strength steel sheet which possesses excellent hydrogen induced cracking resistance, wherein a steel slab which contains 0.01 to 0.12% C, 0.5% or less Si, 0.5 to 1.8% Mn, 0.010 to 0.030% Ti, 0.01 to 0.05% Nb, 0.0005 to 0.0050% Ca such that 0.40 or less of carbon equivalent and 1.5 to 2.0 Ca/O are satisfied is subjected to hot rolling at a temperature of $Ar_3$+100° C. or more and, thereafter, the steel strip is subjected to air cooling for 1 to 20 seconds. Then, the steel strip is cooled down from a temperature not below the $Ar_3$ point, the steel strip is cooled to a temperature of 550 to 650° C. within 20 seconds and, thereafter, the steel strip is coiled at a temperature of 450 to 500° C. According to the technique disclosed in the patent document 2, a line-pipe-use steel sheet of a grade X60 to X70 in accordance with the API standard having hydrogen induced cracking resistance can be manufactured. However, the technique disclosed in patent document 2 cannot secure a desired cooling time when it comes to a steel sheet having a large thickness thus giving rise to a drawback that it is necessary to further enhance cooling ability to secure desired characteristics.

Patent document 3 proposes a method of manufacturing a high strength line-pipe-use plate which possesses excellent hydrogen induced cracking resistance, wherein steel containing 0.03 to 0.06% C, 0.01 to 0.5% Si, 0.8 to 1.5% Mn, 0.0015% or less S, 0.08% or less Al, 0.001 to 0.005% Ca, 0.0030% or less O in a state where Ca, S, and O satisfy a particular relationship is heated, the steel is subjected to accelerated cooling from a temperature of an $Ar_3$ transformation point or more to 400 to 600° C. at a cooling rate of 5° C./s or more and, immediately thereafter, the steel is reheated to a plate surface temperature of 600° C. or more and a plate-thickness-center-portion temperature of 550 to 700° C. at a temperature elevation speed of 0.5° C./s or more thus setting the temperature difference between the plate surface temperature and the plate-thickness-center-portion temperature at a point of time that reheating is completed is set to 20° C. or more. According to the technique disclosed in patent document 3, it is possible to obtain a plate where a structural fraction of a secondary phase in the metal structure is 3% or less, and the difference in hardness between a surface layer and a plate thickness center portion is within 40 points at Vickers hardness thus providing a plate possessing excellent hydrogen induced crack resistance. However, the technique disclosed in patent document 3 requires a reheating step thus giving rise to drawbacks that a manufacturing process becomes complicated, and it is necessary to further provide reheating equipment or the like.

Further, patent document 4 proposes a method of manufacturing steel material having a coarse-grained ferrite layer on front and back surfaces thereof, wherein a slab containing 0.01 to 0.3% C, 0.6% or less Si, 0.2 to 2.0% Mn, 0.06% or less P, S, Al, 0.005 to 0.035% Ti, 0.001 to 0.006% N is subjected to hot rolling, the slab is subjected to rolling at a temperature of $Ac_1$−50° C. or below with cumulative rolling reduction of 2% or more in a cooling step which follows hot rolling and, thereafter, the slab is heated to a temperature above $Ac_1$ and below $Ac_3$, and is gradually cooled. The technique disclosed in patent document 4 is considered to contribute to the enhancement of SCC sensibility (stress corrosion cracking sensibility), weather resistance and corrosion resistance of a plate and, further, the suppression of deterioration of quality of material after cold working and the like. However, the technique disclosed in patent document 4 requires a reheating step thus giving rise to drawbacks that a manufacturing process becomes complicated, and that it is necessary to further provide reheating equipment or the like.

Further, recently, from a viewpoint of preventing burst rupture of a pipeline, it is often the case that a steel pipe for a very cold area is required to possess excellent toughness, and particularly, the excellent CTOD characteristics (crack tip opening displacement characteristics) and DWTT characteristics (drop weight tear test characteristics).

To satisfy such a requirement, for example, patent document 5 discloses a method of manufacturing a hot-rolled steel sheet for a high strength electric resistance welded steel pipe, wherein a slab which contains proper amounts of C, Si, Mn and N, contains Si and Mn to an extent that Mn/Si satisfies 5 to 8, and contains 0.01 to 0.1% Nb is heated and, thereafter, the slab is subjected to rough rolling under conditions where a reduction ratio of first rolling performed at a temperature of 1100° C. or more is 15 to 30%, a total reduction ratio at a temperature of 1000° C. or more is 60% or more and a reduction ratio in final rolling is 15 to 30% and, thereafter, the slab is cooled such that a temperature of a surface layer portion becomes a $Ar_1$ point or below at a cooling rate of 5° C./s or more once and, thereafter, finish rolling is started at a point of time where the temperature of the surface layer portion becomes ($Ac_3$−40° C.) to ($Ac_3$+40° C.) due to recuperation or forced overheating, the finish rolling is completed under conditions where a total reduction ratio at a temperature of 950° C. or below is 60% or more and a rolling completion temperature is the $Ar_3$ point or more, cooling is started within 2 seconds after completing the finish rolling, the slab is cooled to a temperature of 600° C. or below at a speed of 10° C./s, and the slab is coiled within a temperature range of 600° C. to 350° C. According to the steel sheet manufactured by the technique disclosed in patent document 5, it is unnecessary to add expensive alloy elements to the steel sheet, the structure of the surface layer of the steel sheet is made fine without applying heat treatment to the whole steel pipe thus realizing the manufacture of a high strength electric resistance welded steel pipe which possesses excellent low-temperature toughness, and particularly the excellent DWTT characteristics. However, with the technique disclosed in patent document 5, a steel sheet having a large sheet thickness cannot secure desired cooling rate thus giving rise to a drawback that the further enhancement of cooling ability is necessary to secure the desired property.

Further, patent document 6 discloses a method of manufacturing a hot rolled steel strip for a high strength electric resistance welded pipe which possesses excellent low-temperature toughness and excellent weldability, wherein a steel slab which contains proper amounts of C, Si, Mn, Al, N and also contains 0.001 to 0.1% Nb, 0.001 to 0.1% V, 0.001 to 0.1% Ti, also contains one or two kinds or more of Cu, Ni, Mo, and has a Pcm value of 0.17 or less is heated and, thereafter, finish rolling is completed under a condition where a surface temperature is ($Ar_3$−50° C.) or more, and immediately after rolling, the rolled sheet is cooled, and the cooled rolled sheet is gradually cooled at a temperature of 700° C. or below while being coiled.

However, recently, a steel sheet for a high strength electric resistance welded steel pipe is required to further enhance low-temperature toughness, particularly the CTOD characteristics and the DWTT characteristics. With the technique disclosed in patent document 6, the low temperature toughness is not sufficient thus giving rise to a drawback that it is impossible to impart the excellent low-temperature toughness to the steel sheet for a high strength electric resistance welded steel pipe to an extent that the steel sheet sufficiently satisfies the required CTOD characteristics and DWTT characteristics.

Particularly, an extra thick hot rolled steel sheet having a sheet thickness exceeding 22 mm has tendency that cooling of a sheet thickness center portion is delayed compared to cooling of a surface layer portion so that a crystal grain size of the sheet thickness center portion is liable to become coarse thus giving rise to a drawback that the further enhancement of low temperature toughness is difficult.

PATENT DOCUMENT

[Patent document 1] JP-A-08-319538
[Patent document 2] JP-A-09-296216
[Patent document 3] JP-A-2008-056962
[Patent document 4] JP-A-2001-240936
[Patent document 5] JP-A-2001-207220
[Patent document 6] JP-A-2004-315957

SUMMARY OF THE INVENTION

A first aspect of the present invention aims to overcome the above-mentioned drawbacks of the prior art and to provide a thick high-tensile-strength hot-rolled steel sheet which possesses both high strength and excellent ductility without requiring the addition of a large amount of alloy element thus possessing the excellent strength-ductility balance, and possesses excellent low temperature toughness, particularly excellent CTOD characteristics and DWTT characteristics, and which is suitably used for manufacturing a high strength electric resistance welded steel pipe or a high-strength spiral steel pipe, and a method of manufacturing the thick high-tensile-strength hot-rolled steel sheet.

In the first aspect of the invention, "high-tensile-strength hot-rolled steel sheet" means a hot rolled steel sheet having high strength with tensile strength TS of 510 MPa or more, or "thick" steel sheet means a steel sheet having a sheet thickness of 11 mm or more.

In the first aspect of the invention, "excellent CTOD characteristics" means a case where a crack tip opening displacement amount, that is, CTOD value in a CTOD test carried out at a test temperature of −10° C. in accordance with provisions of ASTM E 1290 is 0.30 mm or more.

In the first aspect of the invention, "excellent DWTT characteristics" means a case where a lowest temperature at which percent ductile fracture becomes 85% (DWTT temperature) is −35° C. or below in a DWTT test carried out in accordance with provisions of ASTM E 436.

Further, in the first aspect of the invention, "excellent strength-ductility balance" means a case where TS×El is 18000 MPa % or more. As the elongation El (%), a value which is obtained in a case where a test is carried out using a sheet-shaped specimen (lateral portion width: 12.5 mm, gauge distance GL: 50 mm) is used in accordance with provisions of ASTM E 8.

A second aspect of the present invention aims to provide an extra thick high-tensile-strength hot-rolled steel sheet which has a sheet thickness exceeding 22 mm, possesses high strength with tensile strength of 530 MPa or more and excellent low-temperature toughness, and particularly the excellent CTOD characteristics and DWTT characteristics, and is desirably used for manufacturing a high strength electric resistance welded steel pipe or high strength spiral steel pipe of grade X70 to X80, and a method of manufacturing the extra thick high-tensile-strength hot-rolled steel sheet.

Further, in the second aspect of the invention, "excellent CTOD characteristics" means a case where a crack tip opening displacement amount, that is, CTOD value in a CTOD test carried out at a test temperature of −10° C. in accordance with provisions of ASTM E 1290 is 0.30 mm or more.

Further, in the second aspect of the invention, "excellent low temperature toughness" means a case where a lowest temperature at which percent ductile fracture becomes 85% (DWTT) is −30° C. or below in a DWTT test carried out in accordance with provisions of ASTM E 436.

A third aspect of the present invention aims to provide a thick high-tensile-strength hot-rolled steel sheet which possesses high strength with TS of 560 MPa or more and excellent low-temperature toughness, and particularly the excellent CTOD characteristics and DWTT characteristics, and is desirably used for manufacturing a high strength electric resistance welded steel pipe or high strength spiral steel pipe of grade X70 to X80, and a method of manufacturing the thick high-tensile-strength hot-rolled steel sheet.

Further, in the third aspect of the present invention, "excellent CTOD characteristics" means a case where a crack tip opening displacement amount, that is, CTOD value in a CTOD test carried out at a test temperature of −10° C. in accordance with provisions of ASTM E 1290 is 0.30 mm or more.

In the third aspect, "excellent DWTT characteristics" when the thick high-tensile-strength hot-rolled steel sheet possesses high strength of 560 MPa or more, means a case where a lowest temperature at which percent ductile fracture becomes 85% (DWTT temperature) is −50° C. or below in a DWTT test carried out in accordance with provisions of ASTM E 436.

The inventors of the present invention have made further studies based on a finding obtained through a basic experiment and have made the present invention.

That is, the gist of exemplary aspects of the present invention includes the following features.

According to an exemplary embodiment of the present invention, a high-tensile-strength hot-rolled steel sheet has a composition which contains by mass % 0.02 to 0.08% C, 0.01 to 0.50% Si, 0.5 to 1.8% Mn, 0.025% or less P, 0.005% or less S, 0.005 to 0.10% Al, 0.01 to 0.10% Nb, 0.001 to 0.05% Ti, and Fe as a balance, wherein the steel sheet contains C, Ti and Nb in such a manner that a following formula (1) is satisfied, and the steel sheet has a structure where a primary phase of the structure at a position 1 mm away from a surface of the steel sheet in a sheet thickness direction is one selected from a group consisting of a ferrite phase, tempered martensite and a mixture structure of a ferrite phase and tempered martensite, and a primary phase of the structure at a sheet thickness center position is formed of a ferrite phase, and a difference ΔV between a structural fraction (volume %) of a secondary phase at the position 1 mm away from the surface of the steel sheet in the sheet thickness direction and the structural fraction (volume %) of the secondary phase at the sheet thickness center position is 2% or less.

$$(Ti+(Nb/2))/C<4 \quad (1)$$

Here, Ti, Nb, C: contents of respective elements (mass %)

According to another exemplary embodiment of the present invention, the structure at the position 1 mm away from the surface in the sheet thickness direction is a structure where the primary phase is formed of the ferrite phase, and a difference ΔD between an average grain size of the ferrite phase at the position 1 mm away from the surface in the sheet thickness direction and an average grain size of the ferrite phase at the sheet thickness center position is 2 μm or less.

According to another exemplary embodiment of the present invention, the average grain size of the ferrite phase at the sheet thickness center position is 5 μm or less, the structural fraction (volume %) of the secondary phase is 2% or less, and a sheet thickness is more than 22 mm.

According to yet another embodiment of the present invention, the primary phase of the structure at the position 1 mm away from the surface in the sheet thickness direction is formed of either the tempered martensite structure or the mixture structure of bainite and tempered martensite, the structure at the sheet thickness center position includes the primary phase formed of bainite and/or bainitic ferrite and the secondary phase which is 2% or less by volume %, and a difference ΔHV between Vickers hardness HV1mm at the position 1 mm away from the surface in the sheet thickness direction and Vickers hardness HV1/2t at the sheet thickness center position is 50 points or less.

According to still another exemplary embodiment of the present invention, the high-tensile-strength hot-rolled steel sheet has the composition which further contains by mass % one or two kinds or more selected from 0.01 to 0.10% V, 0.01 to 0.50% Mo, 0.01 to 1.0% Cr, 0.01 to 0.50% Cu, and 0.01 to 0.50% Ni in addition to the above-mentioned composition.

According to yet another exemplary embodiment of the present invention, the high-tensile-strength hot-rolled steel sheet has the composition which further contains by mass % 0.0005 to 0.005% Ca in addition to the above-mentioned composition.

According to another exemplary embodiment of the present invention, a method of manufacturing high-tensile-strength hot-rolled steel sheet is provided, wherein in manufacturing the hot-rolled steel sheet by heating a steel material and by applying hot rolling constituted of rough rolling and finish rolling to the steel material, the accelerated cooling is constituted of primary accelerated cooling and secondary accelerated cooling, wherein the primary accelerated cooling is performed in such a manner that cooling in which an average cooling rate at the sheet thickness center position is 10° C./s or more and a cooling rate difference between an average cooling rate at a sheet thickness center position and an average cooling rate at a position 1 mm away from a surface in a sheet thickness direction is less than 80° C./s is performed until a primary cooling stop temperature by which a temperature at a position 1 mm away from the surface in the sheet thickness direction becomes a temperature in a temperature range of 650° C. or below and 500° C. or above is obtained, and the secondary accelerated cooling is performed in such a manner that cooling in which the average cooling rate at the sheet thickness center position is 10° C./s or more, and the cooling rate difference between the average cooling rate at the sheet thickness center position and the average cooling rate at the position 1 mm away from the surface in the sheet thickness direction is 80° C./s or more is performed until the temperature at the sheet thickness center position becomes a secondary cooling stop temperature of BFS which is defined by a following formula (2) or below, and a hot-rolled steel sheet is coiled at a coiling temperature of BFS0 which is defined by a following formula (3) or below as the temperature at the sheet thickness center position after the secondary accelerated cooling.

$$BFS(^\circ C.)=770-300C-70Mn-70Cr-170Mo-40Cu-40Ni-1.5CR \quad (2)$$

$$BFS0(^\circ C.)=770-300C-70Mn-70Cr-170Mo-40Cu-40Ni \quad (3)$$

Here, C, Mn, Cr, Mo, Cu, Ni: contents of respective elements (mass %)

CR: cooling rate (° C./s)

According to another exemplary embodiment of the present invention, air cooling is performed for 10 s or less between the primary accelerated cooling and the secondary accelerated cooling.

According to another exemplary embodiment of the present invention, the accelerated cooling is performed at the average cooling rate of 10° C./s or more in the temperature range of 750 to 650° C. at the sheet thickness center position.

According to another exemplary embodiment of the present invention, the difference between the cooling stop temperature at the position 1 mm away from the surface in the sheet thickness direction and the coiling temperature in the second accelerated cooling falls within 300° C.

According to another exemplary embodiment of the present invention, the hot-rolled steel sheet has the composition which further contains by mass % one or two kinds or more selected from 0.01 to 0.10% V, 0.01 to 0.50% Mo, 0.01 to 1.0% Cr, 0.01 to 0.50% Cu, and 0.01 to 0.50% Ni in addition to the above-mentioned composition.

According to the twelfth embodiment of the present invention, the hot-rolled steel sheet has the composition which further contains by mass % 0.0005 to 0.005% Ca in addition to the above-mentioned composition.

According to another exemplary embodiment of the present invention, a hot-rolled steel sheet is manufactured by heating a steel material and by applying hot rolling constituted of rough rolling and finish rolling to the steel material and, subsequently, accelerated cooling is applied to the hot-rolled steel sheet after completing the finish rolling at 10° C./s or more in terms of an average cooling rate at a sheet thickness center position until a cooling stop temperature of BFS defined by the following formula (2) or below is obtained, and in coiling the hot-rolled steel sheet at a coiling temperature of BFS0 defined by a following formula (3) or below, a temperature of the hot-rolled steel sheet at the sheet thickness center position is adjusted in such a manner that a holding time through which a temperature of the hot-rolled steel sheet at the sheet thickness center position reaches a temperature (T−20° C.) from a temperature T(° C.) which is a temperature at the time of starting the accelerated cooling is set to 20 s or less, and a cooling time from the temperature T to the temperature of BFS at the sheet thickness center position is set to 30 s or less.

$$BFS(^\circ C.)=770-300C-70Mn-70Cr-170Mo-40Cu-40Ni-1.5CR \quad (2)$$

$$BFS0(^\circ C.)=770-300C-70Mn-70Cr-170Mo-40Cu-40Ni \quad (3)$$

Here, C, Mn, Cr, Mo, Cu, Ni: contents of respective elements (mass %)

CR: cooling rate (° C./s)

According to another exemplary embodiment of the present invention, the hot-rolled steel sheet has the composition which further contains by mass % one or two or more kinds selected from 0.01 to 0.10% V, 0.01 to 0.50% Mo, 0.01 to 1.0% Cr, 0.01 to 0.50% Cu, and 0.01 to 0.50% Ni in addition to the above-mentioned composition.

According to another exemplary embodiment of the present invention, the hot-rolled steel sheet has the composition which further contains by mass % 0.0005 to 0.005% Ca in addition to the above-mentioned composition.

According to another exemplary embodiment of the present invention, in manufacturing a hot-rolled steel sheet by heating a steel material and by applying hot rolling constituted of rough rolling and finish rolling to the steel material, a cooling step which is constituted of first-stage cooling in which the hot-rolled steel sheet is cooled to a cooling stop temperature in a temperature range of an Ms point or below in terms of a temperature at a position 1 mm away from a surface of the hot-rolled steel sheet in the sheet thickness direction at a cooling rate exceeding 80° C./s in terms of an average cooling rate at the position 1 mm away from the surface of the hot-rolled steel sheet in a sheet thickness direction and second-stage cooling in which air cooling is performed for 30 s or less is performed at least twice after completing the hot rolling and, thereafter, third-stage cooling in which the hot-rolled steel sheet is cooled to a cooling stop temperature of BFS defined by the following formula (2) or below in terms of a temperature at a sheet thickness center position at a cooling rate exceeding 80° C./s in terms of an average cooling rate at the position 1 mm away from the surface of the hot-rolled steel sheet in the sheet thickness direction is performed sequentially, and the hot-rolled steel sheet is coiled at a coiling temperature of BFS0 defined by the following formula (3) or below in terms of a temperature at the sheet thickness center position.

$$BFS(^\circ C.)=770-300C-70Mn-70Cr-170Mo-40Cu-40Ni-1.5CR \quad (2)$$

$$BFS0(^\circ C.)=770-300C-70Mn-70Cr-170Mo-40Cu-40Ni \quad (3)$$

Here, C, Mn, Cr, Mo, Cu, Ni: contents of the respective elements (mass %)

CR: cooling rate (° C./s)

According to another exemplary embodiment of the present invention, the hot-rolled steel sheet has the composition which further contains by mass % one or two or more kinds or more selected from 0.01 to 0.10% V, 0.01 to 0.50% Mo, 0.01 to 1.0% Cr, 0.01 to 0.50% Cu, and 0.01 to 0.50% Ni in addition to the above-mentioned composition.

According to another exemplary embodiment of the present invention, the hot-rolled steel sheet has the composition which further contains by mass % 0.0005 to 0.005% Ca in addition to the above-mentioned composition.

According to another exemplary embodiment of the present invention, after the hot-rolled steel sheet is coiled at the coiling temperature, the hot-rolled steel sheet is held in a temperature range from (coiling temperature) to (coiling temperature−50° C.) for 30 min or more.

Unless otherwise specified, "ferrite" means hard low-temperature transformed ferrite, and bainitic ferrite, bainite and a mixture phase of bainitic ferrite and bainite are examples thereof. "ferrite" does not include soft high-temperature transformed ferrite (granular polygonal ferrite) in its concept. Hereinafter, unless otherwise specified, "ferrite" means hard low-temperature transformed ferrite (bainitic ferrite, bainite or a mixture phase of bainitic ferrite and bainite). Further, the secondary phase is one of perlite, martensite, MA (martensite-austenite constituent)(also referred to as island martensite), upper bainite or a mixture phase formed of two or more kinds of these ferrites.

Further, the primary phase means a phase which occupies 90% or more in a structural fraction (volume %), and is more preferably a phase which occupies 98% or more in a structural fraction (volume %).

Still further, in the present invention, a surface temperature of the hot-rolled steel sheet is used as the temperature in the finish rolling. As the temperature at the sheet thickness center position, the cooling rate and the coiling temperature, values which are calculated by the heat transfer calculation or the like based on the measured surface temperature are used.

According to aspects of the present invention, the thick high-tensile-strength hot-rolled steel sheet which exhibits small fluctuation of structure in the sheet thickness direction, possesses excellent strength-ductility balance, and further possesses the excellent low-temperature toughness, particularly DWTT characteristics and CTOD characteristics can be manufactured easily and at a low cost and hence, thus providing industrially outstanding advantageous effects. Further, a line-pipe-use electric resistance welded steel pipe or a line-pipe-use spiral steel pipe which possesses the excellent strength-ductility balance, the excellent low-temperature toughness and the excellent girth weldability at the time of constructing pipelines can be easily manufactured.

According to another aspect of the present invention, the extra thick high-tensile-strength hot-rolled steel sheet which has the fine structure at the sheet thickness center portion, exhibits small fluctuation of structure in the sheet thickness direction, has a very heavy thickness exceeding 22 mm, possesses high strength with tensile strength TS of 530 MPa or more, possesses the excellent low-temperature toughness, particularly both of excellent DWTT characteristics and excellent CTOD characteristics can be manufactured easily and at a low cost and hence, thus providing industrially outstanding advantageous effects. Further, a line-pipe-use electric resistance welded steel pipe or a line-pipe-use spiral steel pipe which possesses excellent low-temperature toughness and the excellent girth weldability at the time of constructing pipelines can be easily manufactured.

According to another aspect of the present invention, the thick high-tensile-strength hot-rolled steel sheet which possesses high strength with tensile strength TS of 560 MPa or more, possesses the excellent low-temperature toughness, particularly both of excellent CTOD characteristics and excellent DWTT characteristics, and is preferably used for manufacturing a high strength electric resistance welded steel pipe or high strength spiral steel pipe of grade X70 to X80 can be manufactured easily and at a low cost without requiring the addition of a large amount of alloy elements and hence, thus providing industrially outstanding advantageous effects. Further, a line-pipe-use electric resistance welded steel pipe or a line-pipe-use spiral steel pipe which possesses excellent low-temperature toughness, the excellent girth weldability at the time of constructing pipelines, and the excellent sour gas resistances can be easily manufactured.

DETAILED DESCRIPTION OF THE INVENTION

Figure 1:
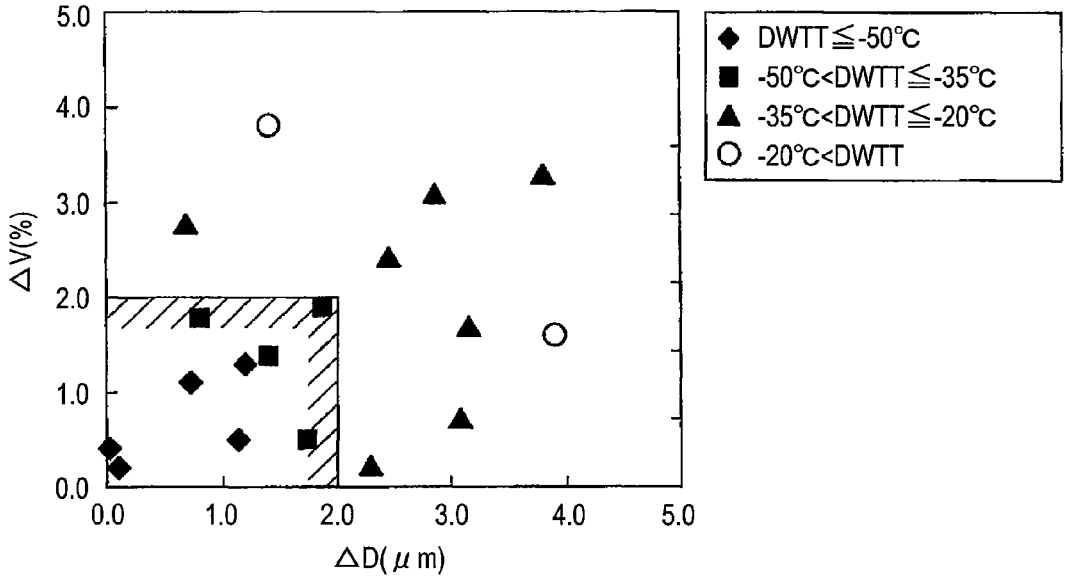
FIG. 1 is a graph showing the relationship between DWTT and ΔD, ΔV according to an aspect of the invention.

Inventors of the present invention have extensively studied respective factors which influence the low-temperature toughness, particularly DWTT characteristics and CTOD characteristics. As a result, the inventors have come up with an idea that DWTT characteristics and CTOD characteristics which are toughness tests in total thickness are largely influenced by uniformity of structure in the sheet thickness direction. Further, the inventors of the present invention have found that the influence exerted on DWTT characteristics and CTOD characteristics in the sheet thickness direction which are toughness tests in total thickness by non-uniformity of structure in the sheet thickness direction appears conspicuously with a thick-wall material having a sheet thickness of 11 mm or more.

According to the further studies made by the inventors of the present invention, the inventors have found that a steel sheet which possesses "excellent DWTT characteristics" and "excellent CTOD characteristics" is surely obtainable when the structure at a position 1 mm away from a surface of the steel sheet in the sheet thickness direction is the structure where a primary phase is formed of a ferrite phase, tempered martensite or the mixture structure of the ferrite phase and the tempered martensite which possess sufficient toughness, and the difference ΔV between a structural fraction (volume %) of a secondary phase at the position 1 mm away from the surface in the sheet thickness direction and the structural fraction (volume %) of the secondary phase at the sheet thickness center position is 2% or less.

Further, according to the further studies made by the inventors of the present invention, the inventors have found that "excellent DWTT characteristics" and "excellent CTOD characteristics" are surely obtainable when the difference ΔD between an average grain size of the ferrite at the position 1 mm away from the surface in the sheet thickness direction (surface layer portion) and an average grain size of the ferrite at the sheet thickness center position (sheet thickness center portion) is 2 μm or less, and the difference ΔV between a structural fraction (volume fraction) of a secondary phase at the position 1 mm away from the surface in the sheet thickness direction (surface layer portion) and the structural fraction (volume fraction) of the secondary phase at the sheet thickness center position (sheet thickness center portion) is 2% or less.

However, with respect to the extra thick hot-rolled steel sheet having a sheet thickness exceeding 22 mm, even when ΔD and ΔV fall within the above-mentioned ranges, the DWTT characteristics are deteriorated so that the desired "excellent DWTT characteristics" cannot be secured. In view of the above, the inventors of the present invention have thought that, in the extra thick hot-rolled steel sheet having a sheet thickness exceeding 22 mm, cooling of the sheet thickness center portion is delayed compared to cooling of the surface layer portion so that crystal grains are liable to become coarse whereby a grain size of ferrite at the sheet thickness center portion becomes coarse leading to the increase of a secondary phase. In view of the above, the inventors of the present invention have further extensively studied a method of adjusting the structure of the sheet thickness center portion of the extra thick hot-rolled steel sheet. As a result, the inventors of the present invention have found that it is crucially important to shorten a time during which a steel sheet stays in high temperature range by setting a holding time in which a temperature of the steel sheet at the sheet thickness center position is lowered by 20° C. from a temperature T(° C.) at the time of starting accelerated cooling after completing the finish rolling to not more than 20 s, and to set a cooling time during which the temperature of the steel sheet at the sheet thickness center portion is lowered to a BFS temperature defined by the following formula (2) from the temperature T(° C.) at the time of starting accelerated cooling after completing the finish rolling to not more than 30 s.

$$BFS(^\circ C.)=770-300C-70Mn-70Cr-170Mo-40Cu-40Ni-1.5CR \quad (2)$$

(here, C, Mn, Cr, Mo, Cu, Ni: contents of respective elements (mass %), CR: cooling rate (° C./s))

The inventors of the present invention have also found that due to such setting, the structure of the sheet thickness center portion becomes the structure where the average grain size of the ferrite phase is 5 μm or less, and the structural fraction (volume %) of the secondary phase is 2% or less.

According to the further studies made by the inventors of the present invention, it is newly found that "excellent DWTT characteristics" that DWTT is −50° C. or below is surely obtainable by forming the structure of the surface layer portion into either tempered martensite or the mixture structure of bainite and tempered martensite having sufficient toughness, by forming the structure at the sheet thickness center position into the structure which includes bainite and/or bainitic ferrite as a primary phase and a secondary phase which is 2% or less of the structure, and by allowing the structure of the steel sheet to have the uniform hardness in the sheet thickness direction such that the difference ΔHV in Vickers hardness between the surface layer and the sheet thickness center portion is 50 points or less. Then, the inventors of the present invention have found that such structure can be easily formed by sequentially performing, after completing hot rolling, first-stage cooling in which rapid cooling which forms a surface layer into either a martensite phase or the mixture structure of bainite and martensite, second cooling in which air cooling is performed for a predetermined time after the first-stage cooling and third-stage cooling in which rapid cooling is performed, and by tempering the martensite phase formed by the first-stage cooling by coiling.

According to the further studies made by the inventors of the present invention, it is found that a cooling stop temperature and a coiling temperature necessary for forming the structure at the sheet thickness center position into the structure where a primary phase is formed of bainite and/or bainitic ferrite are decided mainly depending on contents of alloy elements which influence a bainite transformation start temperature and a cooling rate from finishing hot rolling. That is, it is crucially important to set the cooling stop temperature to a temperature BFS defined by the following formula or below and to set the coiling temperature to BFS defined by the following formula or below.

$$BFS(^\circ C.)=770-300C-70Mn-70Cr-170Mo-40Cu-40Ni-1.5CR$$

(Here, C, Mn, Cr, Mo, Cu, Ni: contents of respective elements (mass %), CR: cooling rate (° C./s))

$$BFS0(^\circ C.)=770-300C-70Mn-70Cr-170Mo-40Cu-40Ni$$

(Here, C, Mn, Cr, Mo, Cu, Ni: contents of respective elements (mass %))

Firstly, a result of an experiment from which the first aspect of the present invention is originated is explained.

A slab containing by mass % 0.037% C, 0.20% Si, 1.59% Mn, 0.016% P, 0.0023% S, 0.041% Al, 0.061% Nb, 0.013% Ti, and Fe as a balance is used as a raw steel material. Here, (Ti+Nb/2)/C is set to 1.18.

The raw steel material having the above-mentioned composition is heated to a temperature of 1230° C. and is subjected to hot rolling under conditions where a finish rolling start temperature is 980° C. and a finish rolling completion temperature is 800° C. thus forming a hot-rolled sheet having a sheet thickness of 12.7 mm. After hot rolling, accelerated cooling is applied to the hot-rolled sheet in such a manner that the hot-rolled steel sheet is cooled down to various cooling stop temperatures at a cooling rate of 18° C./s in a temperature range where the temperature of the sheet thickness center portion is 750° C. or below and, thereafter, the hot-rolled steel sheet is coiled at various coiling temperatures to manufacture hot-rolled steel sheet (steel strip).

Specimens are sampled from the obtained hot-rolled steel sheet and the DWTT characteristics and the structure are investigated. With respect to the structure, an average grain size (μm) of ferrite and the structural fraction (volume %) of the secondary phase are obtained with respect to the position 1 mm away from the surface in the sheet thickness direction (surface layer portion) and the sheet thickness center position (sheet thickness center portion). Based on obtained measured values, the difference ΔD in the average grain size of the ferrite phase and the difference ΔV in the structural fraction of the secondary phase between the position 1 mm away from the surface in the sheet thickness direction (surface layer portion) and the sheet thickness center position (sheet thickness center portion) are calculated respectively. Here, "ferrite" means hard low-temperature transformed ferrite (bainitic ferrite, bainite or a mixture phase of bainitic ferrite and bainite). "Ferrite" does not include soft high-temperature transformed ferrite (granular polygonal ferrite) in its concept. The secondary phase is one of perlite, martensite, MA and the like.

The obtained result is shown in FIG. 1 in the form of the relationship between ΔD and ΔV which influence DWTT.

It is found from FIG. 1 that "excellent DWTT characteristics" in which DWTT becomes −35° C. or below can be surely maintained when ΔD is not more than 2 μm and ΔV is not more than 2%.

Figure 2:
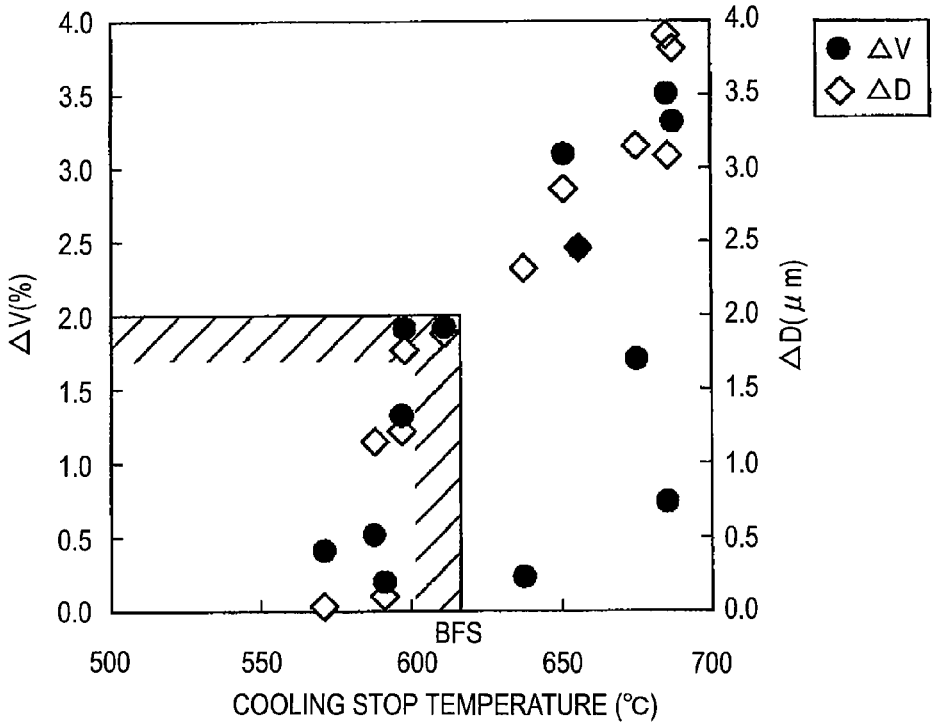
FIG. 2 is a graph showing the relationship between ΔD, ΔV and a cooling stop temperature in accelerated cooling according to an aspect of the invention.
Figure 3:
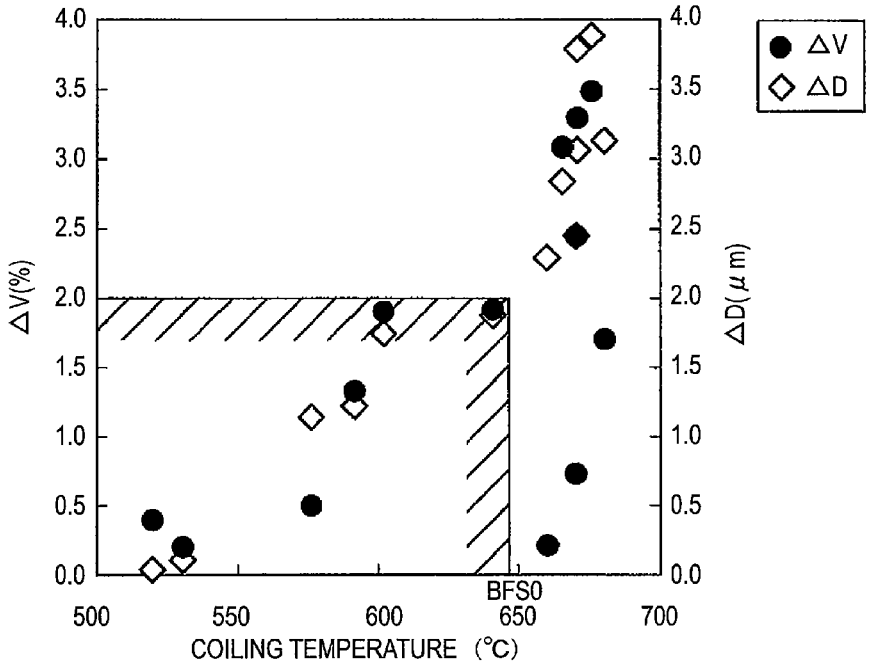
FIG. 3 is a graph showing the relationship between ΔD, ΔV and a coiling temperature according to an aspect of the invention.

Next, the relationship between ΔD, ΔV and a cooling stop temperature is shown in FIG. 2, and the relationship between ΔD, ΔV and a coiling temperature is shown in FIG. 3.

It is understood from FIG. 2 and FIG. 3 that it is advantageous to adjust the cooling stop temperature to 620° C. or below and the coiling temperature to 647° C. or below in used steels to set ΔD to not more than 2 μm and ΔV to not more than 2%.

According to the further studies made by the inventors of the present invention, it is found that a cooling stop temperature and a coiling temperature for setting ΔD to not more than 2 μm and ΔV to not more than 2% are decided mainly depending on contents of alloy elements which influence a bainite transformation start temperature and a cooling rate from finishing hot rolling. That is, to set ΔD to not more than 2 μm and ΔV to not more than 2%, it is crucially important to set the cooling stop temperature to a temperature BFS defined by the following formula or below, and to set the coiling temperature to a temperature BFS0 defined by the following formula or below.

$$BFS(^\circ C.)=770-300C-70Mn-70Cr-170Mo-40Cu-40Ni-1.5CR$$

(here, C, Mn, Cr, Mo, Cu, Ni: contents of respective elements (mass %), CR: cooling rate (° C./s))

$$BFS0(^\circ C.)=770-300C-70Mn-70Cr-170Mo-40Cu-40Ni$$

(here, C, Mn, Cr, Mo, Cu, Ni: contents of respective elements (mass %))

Figure 4:
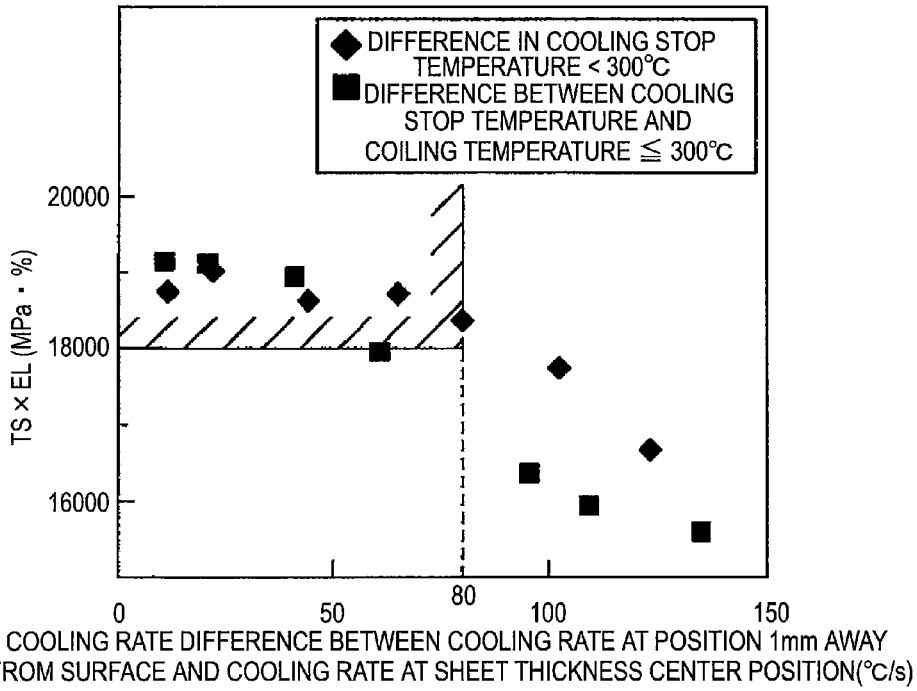
FIG. 4 is a graph showing the relationship between the strength-ductility balance TS×El and the difference between a cooling rate at a position 1 mm away from a surface in a sheet thickness direction and a cooling rate at a sheet thickness center position according to an aspect of the invention.

Next, the inventors of the present invention further studied the influence of a cooling condition exerted on the enhancement of ductility. A result of the study is shown in FIG. 4. FIG. 4 shows the result of investigation where water quantity density during the first cooling is increased in such a manner that the difference in average cooling rate is changed between the surface layer and the sheet thickness center portion in cooling in a temperature range of a temperature of 500° C. or more, and the difference in average cooling rate between the surface layer and the sheet thickness center portion in cooling in a temperature range below the temperature of 500° C. is set to 80° C./s or more and, further, the cooling stop temperature and the coiling temperature are variously changed, and the strength-ductility balance is investigated. As shown in FIG. 4, it is found that, in cooling the hot-rolled steel sheet after hot rolling, by adjusting the cooling condition such that the difference in average cooling rate between the surface layer and the sheet thickness center portion falls within a specified range (less than 80° C./s) in the temperature range up to 500° C., ductility is remarkably enhanced in addition to the enhancement of low-temperature toughness so that the strength-ductility balance TS×El becomes stable and becomes 18000 MPa % or more. It is understood from FIG. 4 that when the difference between the cooling stop temperature and the coiling temperature becomes below 300° C., the strength-ductility balance TS×El becomes more stable and becomes 18000 MPa % or more.

Firstly, a result of an experiment from which the second aspect of the present invention is originated is explained.

A slab containing by mass % 0.039% C, 0.24% Si, 1.61% Mn, 0.019% P, 0.0023% S, 0.038% Al, 0.059% Nb, 0.010% Ti, and Fe as a balance is used as a raw steel material. Here, (Ti+Nb/2)/C is set to 1.0.

The raw steel material having the above-mentioned composition is heated to a temperature of 1200° C. and is subjected to hot rolling under conditions where a finish rolling start temperature is 1000° C. and a finish rolling completion temperature is 800° C. thus forming a hot-rolled sheet having a sheet thickness of 23.8 mm. After hot rolling, accelerated cooling is applied to the hot-rolled steel sheet under various conditions and, thereafter, the hot-rolled sheet is coiled at various coiling temperatures to manufacture hot-rolled steel sheet (steel strip).

Specimens are sampled from the obtained hot-rolled steel sheet and the DWTT characteristics and the structure are investigated. With respect to the structure, an average grain size (μm) of ferrite phase and the structural fraction (volume %) of the secondary phase are obtained with respect to the position 1 mm away from the surface in the sheet thickness direction (surface layer portion) and the sheet thickness center position (sheet thickness center portion). Based on obtained measured values, the difference ΔD in the average grain size of the ferrite phase and the difference ΔV in the structural fraction of the secondary phase between the position 1 mm away from the surface in the sheet thickness direction (surface layer portion) and the sheet thickness center position (sheet thickness center portion) are calculated respectively.

Figure 5:
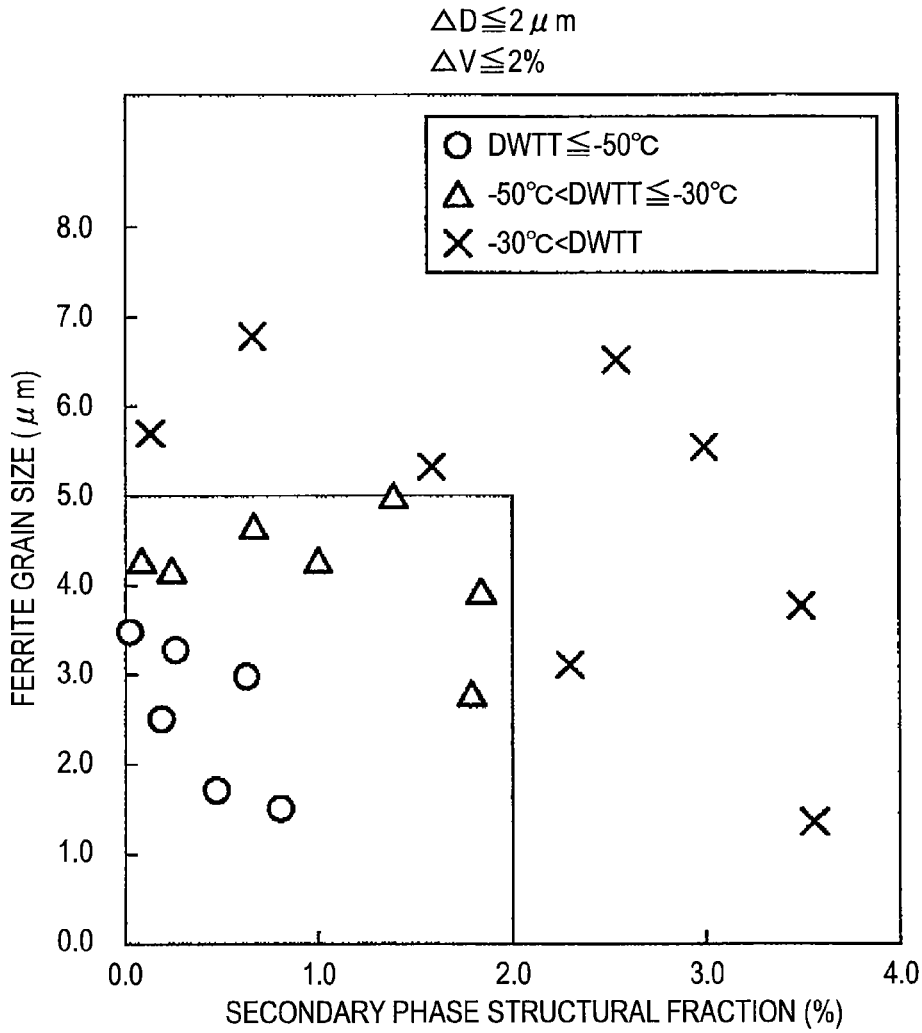
FIG. 5 is a graph showing the relationship between an average grain size of a ferrite phase at a sheet thickness center position and a structural fraction of a secondary phase which influences DWTT according to an aspect of the invention.

The obtained result is shown in FIG. 5 in the form of the relationship between an average grain size in a ferrite phase and a structural fraction of a secondary phase at a sheet thickness center portion which influence DWTT. FIG. 5 shows the result when ΔD is not more than 2 μm and ΔV is not more than 2%.

It is understood from FIG. 5 that when the average grain size in the ferrite phase is not more than 5 μm and the structural fraction of the secondary phase is not more than 2% at the sheet thickness center portion, it is possible to obtain the steel sheet possessing "excellent DWTT characteristics" where DWTT is −30° C. or below although the hot-rolled steel sheet has a very heavy thickness.

The present invention has been completed based on such findings and the study on these findings.

Methods of manufacturing a hot-rolled steel sheet according to embodiments of the present invention are explained.

In exemplary methods of manufacturing a hot-rolled steel sheet, a raw steel material having the predetermined composition is heated, and is subjected to hot rolling consisting of rough rolling and finish rolling thus manufacturing a hot-rolled steel sheet. The methods of manufacturing a hot-rolled steel sheet optionally adopt the same manufacturing steps up to finish rolling of the hot-rolled steel sheet.

Firstly, the reason that the composition of the raw steel materials according to embodiments of the present invention is optionally limited is explained. Unless otherwise specified, mass % is simply described as %

C: 0.02 to 0.08%

C is an element which performs the action of increasing strength of steel. In embodiments of this invention, the hot-rolled steel sheet is required to contain 0.02% or more of C for securing desired high strength. On the other hand, when the content of C exceeds 0.08%, a structural fraction of a secondary phase such as perlite is increased so that parent material toughness and toughness of a welded heat affected zone are deteriorated. Accordingly, the content of C is limited to a value which falls within a range from 0.02 to 0.08%. The content of C is preferably set to a value which falls within a range from 0.02 to 0.05%.

Si: 0.01 to 0.50%

Si performs the action of increasing strength of steel through solution strengthening and the enhancement of quenching property. Such an advantageous effect can be acquired when the content of Si is 0.01% or more. On the other hand, Si performs the action of concentrating C into a γ phase (austenite phase) in transformation from γ (austenite) to α (ferrite) thus promoting the formation of a martensite phase as a secondary phase whereby ΔD is increased and toughness of the steel sheet is deteriorated as a result. Further, Si forms oxide which contains Si at the time of electric resistance welding so that quality of a welded seam is deteriorated and, at the same time, toughness of a welded heat affected zone is deteriorated. From such a viewpoint, although it is desirable to reduce the content of Si as much as possible, the content of Si up to 0.50% is allowable. Accordingly, the content of Si is limited to a value which falls within a range from 0.01% to 0.50%. The content of Si is preferably set to 0.40% or less.

The hot-rolled steel sheet for an electric resistance welded steel pipe contains Mn and hence, Si forms manganese silicate having a low melting point and oxide is easily discharged from a welded seam whereby the hot-rolled steel sheet may contain 0.10 to 0.30% Si.

Mn: 0.5 to 1.8%

Mn performs the action of enhancing quenching property so that Mn increases strength of the steel sheet through the enhancement of quenching property. Further, Mn forms MnS thus fixing S and hence, the grain boundary segregation of S is prevented whereby cracking of slab (raw steel material) can be suppressed. To acquire such an advantageous effect, it is beneficial to set the content of Mn to 0.5% or more.

On the other hand, when the content of Mn exceeds 1.8%, solidification segregation at the time of casting slab is promoted so that Mn concentrated parts remain in a steel sheet so that the occurrence of separation is increased. To dissipate the Mn concentrated parts, it is beneficial to heat the hot-rolled steel sheet at a temperature exceeding 1300° C. and it is unrealistic to carry out such heat treatment in an industrial scale. Accordingly, the content of Mn is limited to a value which falls within a range from 0.5 to 1.8%. The content of Mn is preferably limited to a value which falls within a range from 0.9 to 1.7%.

P: 0.025% or Less

Although P is contained in steel as an unavoidable impurity, P performs the action of increasing strength of steel. However, when the content of P exceeds 0.025%, weldability is deteriorated. Accordingly, the content of P is limited to 0.025% or less. The content of P is preferably limited to 0.015% or less.

S: 0.005% or Less

S is also contained in steel as an unavoidable impurity in the same manner as P. However, when the content of S exceeds 0.005%, cracks occur in slab, and coarse MnS is formed in a hot-rolled steel sheet thus deteriorating ductility. Accordingly, the content of S is limited to 0.005% or less. The content of S is preferably limited to 0.004% or less.

Al: 0.005 to 0.10%

Al is an element which acts as a deoxidizer and it is desirable to set the content of Al in the hot-rolled steel sheet to 0.005% or more to acquire such an advantageous effect. On the other hand, when the content of Al exceeds 0.10%, cleanability of a welded seam at the time of electric resistance welding is remarkably deteriorated. Accordingly, the content of Al is limited to a value which falls within a range from 0.005 to 0.10%. The content of Al is preferably limited to 0.08% or less.

Nb: 0.01 to 0.10%

Nb is an element which performs the action of suppressing the increase of grain size and the recrystallization of austenite. Nb enables rolling in an austenite un-recrystallization temperature range by hot finish rolling and is finely precipitated as carbonitride so that weldability is not deteriorated, and Nb performs the action of increasing strength of hot-rolled steel sheet with the small content. To acquire such advantageous effects, it is beneficial to set the content of Nb to 0.01% or more. On the other hand, when the content of Nb exceeds 0.10%, a rolling load during hot finish rolling is increased and hence, there may be a case where hot rolling becomes difficult. Accordingly, the content of Nb is limited to a value which falls within a range from 0.01 to 0.10%. The content of Nb is preferably limited to a value which falls within a range from 0.03% to 0.09%.

Ti: 0.001 to 0.05%

Ti performs the action of preventing cracks in slab (raw steel material) by forming nitride thus fixing N, and is finely precipitated as carbide so that strength of a steel sheet is increased. Although such an advantageous effect is remarkably apparent when the content of Ti is 0.001% or more, when the content of Ti exceeds 0.05%, a yield point is remarkably elevated due to precipitation strengthening. Accordingly, the content of Ti is limited to a value which falls within a range from 0.001 to 0.05%. The content of Ti is preferably limited to a value which falls within a range from 0.005% to 0.035%.

In embodiments of the present invention, the hot-rolled steel sheet contains Nb, Ti, C which fall in the above-mentioned ranges, and the contents of Nb, Ti, C are adjusted such that the following formula (1) is satisfied.

$$(Ti+(Nb/2))/C<4 \quad (1)$$

Nb, Ti are element which have strong carbide forming tendency, wherein most of C is turned into carbide when the content of C is low, and the drastic decrease of solid-solution C content within ferrite grains is considered. The drastic decrease of solid-solution C content within ferrite grains adversely influences girth welding property at the time of constructing pipelines. When girth welding is applied to a steel pipe which is manufactured using a steel sheet in which the solid-solution C content in ferrite grains is extremely lowered as a line pipe, the grain growth in a heat affected zone of a girth welded part becomes conspicuous thus giving rise to a possibility that toughness of the heat affected zone of the girth welded part is deteriorated. Accordingly, the contents of Nb, Ti, C are adjusted so as to satisfy the formula (1). Due to such adjustment, the solid-solution C content in ferrite grains can be set to 10 ppm or more and hence, the deteriorating of toughness of the heat affected zone of the girth weld portion can be prevented.

Although the above-mentioned contents are basic contents of the hot-rolled steel sheet, in addition to the basic composition, as selected elements, the hot-rolled steel sheet may selectively contain one or two kinds or more selected from a group consisting of 0.01 to 0.10% V, 0.01 to 0.50% Mo, 0.01 to 1.0% Cr, 0.01 to 0.50% Cu, 0.01 to 0.50% Ni, and/or 0.0005 to 0.005% Ca if necessary.

Although the hot-rolled steel sheet may selectively contain one or two kinds or more selected from a group consisting of 0.01 to 0.10% V, 0.01 to 0.50% Mo, 0.01 to 1.0% Cr, 0.01 to 0.50% Cu and 0.01 to 0.50% Ni if necessary, since all of V, Mo, Cr, Cu and Ni are elements which enhance quenching property and increase strength of the steel sheet.

V is an element which performs the action of increasing strength of a steel sheet through the enhancement of quenching property and the formation of carbonitride. Such an advantageous effect becomes outstanding when the content of V is 0.01% or more. On the other hand, when the content of V exceeds 0.10%, the weldability is deteriorated. Accordingly, the content of V is preferably limited to a value which falls within a range from 0.01% to 0.10%. The content of V is more preferably limited to a value which falls within a range from 0.03 to 0.08%.

Mo is an element which performs the action of increasing strength of a steel sheet through the enhancement of quenching property and the formation of carbonitride. Such an advantageous effect becomes outstanding when the content of Mo is 0.01% or more. On the other hand, when the content of Mo exceeds 0.50%, the weldability is deteriorated. Accordingly, the content of Mo is preferably limited to a value which falls within a range from 0.01 to 0.50%. The content of Mo is more preferably limited to a value which falls within a range from 0.05 to 0.30%.

Cr is an element which performs the action of increasing strength of a steel sheet through the enhancement of quenching property. Such an advantageous effect becomes outstanding when the content of Cr is 0.01% or more. On the other hand, when the content of Cr exceeds 1.0%, there arises a tendency that a welding defect frequently occurs at the time of electric resistance welding. Accordingly, the content of Cr is preferably limited to a value which falls within a range from 0.01% to 1.0%. The content of Cr is more preferably limited to a value which falls within a range from 0.01 to 0.80%.

Cu is an element which performs the action of increasing strength of a steel sheet through the enhancement of quenching property and solution strengthening or precipitation strengthening. To acquire such an advantageous effect, the content of Cu is desirably set to 0.01% or more. However, when the content of Cu exceeds 0.50%, hot-rolling workability is deteriorated. Accordingly, the content of Cu is preferably limited to a value which falls within a range from 0.01 to 0.50%. The content of Cu is more preferably limited to a value which falls within a range from 0.10 to 0.40%.

Ni is an element which performs the action of increasing strength of steel through the enhancement of quenching property and also performs the action of enhancing toughness of a steel sheet. To acquire such an advantageous effect, the content of Ni is preferably set to 0.01% or more. However, even when the content of Ni exceeds 0.50%, the advantageous effect is saturated so that an advantageous effect corresponding to the content is not expected whereby the content of Ni exceeding 0.50% is economically disadvantageous. Accordingly, the content of Ni is preferably limited to a value which falls within a range from 0.01 to 0.50%. The content of Ni is more preferably limited to a value which falls within a range from 0.10 to 0.40%.

Ca: 0.0005 to 0.005%

Ca is an element which fixes S as CaS and performs the action of controlling the configuration of sulfide inclusion by forming the sulfide inclusion into a spherical shape, and performs the action of lowering hydrogen trapping ability by making a lattice strain of a matrix around the inclusion small. To acquire such an advantageous effect, the content of Ca is desirably 0.0005% or more. However, when the content of Ca exceeds 0.005%, CaO is increased so that corrosion resistance and toughness are deteriorated. Accordingly, when the hot-rolled steel sheet contains Ca, the content of Ca is preferably limited to a value which falls within a range from 0.0005 to 0.005%. The content of Ca is more preferably limited to a value which falls within a range from 0.0009 to 0.003%.

The balance other than the above-mentioned components is constituted of Fe and unavoidable impurities. As unavoidable impurities, the hot-rolled steel sheet is allowed to contain 0.005% or less N, 0.005% or less O, 0.003% or less Mg, and 0.005% or less Sn.

N: 0.005% or Less

Although N is unavoidably contained in steel, the excessive content of N frequently causes cracks at the time of casting a raw steel material (slab). Accordingly, the content of N is preferably limited to 0.005% or less. The content of N is more preferably limited to 0.004% or less.

O: 0.005% or less

O is present in the form of various oxides in steel and becomes a cause which lowers hot-rolling workability, corrosion resistance, toughness and the like. Accordingly, it is desirable to reduce the content of O as much as possible. However, the hot-rolled steel sheet is allowed to contain the content of O up to 0.005%. Since the extreme reduction of O brings about the sharp rise of a refining cost, the content of O is desirably limited to 0.005% or less.

Mg: 0.003% or less

Mg forms oxides and sulfides in the same manner as Ca and performs the action of suppressing the formation of coarse MnS. However, when the content of Mg exceeds 0.003%, clusters of Mg oxides and Mg sulfides are generated frequently thus deteriorating toughness. Accordingly, the content of Mg is desirably limited to 0.003% or less.

Sn: 0.005% or less

Sn is mixed into the hot-rolled steel sheet in the form of scrap used as a steel-making raw material. Sn is an element which is liable to be segregated in a grain boundary or the like and hence, when the content of Sn becomes large exceeding 0.005%, grain boundary strength is deteriorated thus deteriorating toughness. Accordingly, the content of Sn is desirably limited to 0.005% or less.

The structure of the hot-rolled steel sheet in embodiments of the present invention is the structure which has the above-mentioned composition, in which the primary phase of the structure at the position 1 mm away from the surface in the sheet thickness direction is formed of any one of a ferrite phase, tempered martensite and the mixture structure consisting of the ferrite phase and tempered martensite which have sufficient toughness, and in which the difference ΔV between a structural fraction (volume %) of the secondary phase at the position 1 mm away from the surface in the sheet thickness direction and the structural fraction (volume %) of the secondary phase at the sheet thickness center position is 2% or less.

Here, unless otherwise specified, "ferrite" means hard low-temperature transformed ferrite (bainitic ferrite, bainite or a mixture phase of bainitic ferrite and bainite). "ferrite" does not include soft high-temperature transformed ferrite (granular polygonal ferrite) in its concept. Further, the secondary phase is one of perlite, martensite, MA (also referred to as island martensite), upper bainite and a mixture phase formed of two or more kinds of these phases.

When the structure is the structure where the primary phase of the structure at the position 1 mm away from the surface in the sheet thickness direction is formed of any one of the ferrite phase, tempered martensite and the mixture structure consisting of the ferrite phase and the tempered martensite which have sufficient toughness and when ΔV is 2% or less, the low-temperature toughness, particularly the DWTT characteristics and the CTOD characteristics are remarkably enhanced. When the structure at the position 1 mm away from the surface in the sheet thickness direction is the structure other than the above-mentioned structure or either one of ΔV falls outside a desired range, the DWTT characteristics are deteriorated so that low-temperature toughness is deteriorated.

As the further preferred structure of the hot-rolled steel sheet, the following modes of three invention embodiments are listed corresponding to targeted strength level, targeted sheet thickness, targeted DWTT characteristics and targeted CTOD characteristics.

(1) First embodiment of the present invention: high-tensile-strength hot-rolled steel sheet having TS of 510 MPa or more and sheet thickness of 11 mm or more (2) Second embodiment of the present invention: extra thick high-tensile-strength hot-rolled steel sheet having TS of 530 MPa or more and sheet thickness exceeding 22 mm (3) Third embodiment of the present invention: high-tensile-strength hot-rolled steel sheet having TS of 560 MPa or more Next, preferred methods of manufacturing hot-rolled steel sheets are explained.

As a method of manufacturing a raw steel material, it is preferable to manufacture the raw steel material in such a manner that molten steel having the above-mentioned composition is produced by a usual melting method such as a converter, and molten metal is cast into the raw steel material such as slab by a usual casting method such as continuous casting method. However, the present invention is not limited to such a method.

The raw steel material having the above-mentioned composition is subjected to hot rolling by heating. The hot rolling is constituted of rough rolling which turns the raw steel material into a sheet bar, and finish rolling which turns the sheet bar into a hot-rolled sheet.

Although heating temperature of a raw steel material is not necessarily limited provided that the raw steel material can be rolled into a hot-rolled sheet, the heating temperature is preferably set to a temperature which falls within a range from 1100 to 1300° C. When the heating temperature is below 1100° C., the deformation resistance is high so that a rolling load is increased whereby a load applied to a rolling mill becomes excessively large. On the other hand, when the heating temperature becomes high exceeding 1300° C., crystal grains become coarse so that low-temperature toughness is deteriorated, and a scale generation amount is increased so that a process yield is lowered. Accordingly, the heating temperature in hot rolling is preferably set to a value which falls within a range from 1100 to 1300° C.

A sheet bar is formed by applying rough rolling to the heated raw steel material. Conditions for rough rolling are not necessarily limited provided that the sheet bar of desired size and shape is obtained. From a viewpoint of securing toughness, a rolling completion temperature in rough rolling is preferably set to 1050° C. or below.

Finish rolling is further applied to the obtained sheet bar. It is preferable to apply accelerated cooling to the sheet bar before finish rolling or to adjust a finish rolling start temperature by oscillations or the like on a table. Due to such an operation, a reduction ratio in a temperature range effective for high toughness can be increased in a finish rolling mill.

In finish rolling, from a viewpoint of high toughness, an effective reduction ratio is preferably set to 20% or more. Here, "effective reduction ratio" means a total reduction amount (%) in a temperature range of 950° C. or below. To achieve the desired high toughness over the whole sheet thickness, the effective reduction ratio at the sheet thickness center portion is preferably set to 20% or more. The effective reduction ratio at the sheet thickness center portion is more preferably set to 40% or more.

After hot rolling (finish rolling) is completed, accelerated cooling is applied to the hot-rolled sheet on a hot run table. It is desirable to start accelerated cooling with the temperature at the sheet thickness center portion held at a temperature of 750° C. or more. When the temperature at the sheet thickness center portion becomes less than 750° C., high-temperature transformed ferrite (polygonal ferrite) is formed, and a secondary phase is formed around polygonal ferrite by C which is discharged at the time of transformation from γ to α. Accordingly, a precipitation fraction of the secondary phase becomes high at the sheet thickness center portion whereby the above-mentioned desirable structure cannot be formed.

The cooling method after the finish rolling is influential according to aspects of the present invention. That is, it is beneficial to select the optimum cooling method after hot rolling corresponding to a strength level, sheet thickness, DWTT characteristics and CTOD characteristics of the targeted hot-rolled steel sheet.

Hereinafter, specific modes are explained in order.

Although three modes adopt the same basic composition range and the same conditions up to hot rolling, different hot-rolled steel sheets which have the targeted structure and the targeted performance are manufactured by selecting optimum cooling conditions after hot rolling.

(1) First embodiment of the present invention: high-tensile-strength hot-rolled steel sheet having TS of 510 MPa or more and sheet thickness of 11 mm or more (2) Second embodiment of the present invention: extra thick high-tensile-strength hot-rolled steel sheet having TS of 530 MPa or more and sheet thickness exceeding 22 mm (3) Third embodiment of the present invention: high-tensile-strength hot-rolled steel sheet having TS of 560 MPa or more

Mode of First Embodiment of the Present Invention

The high-tensile-strength hot-rolled steel sheet having TS of 510 MPa or more and a sheet thickness of 11 mm or more has the above-mentioned composition, and has the structure where the primary phase of the structure at the position 1 mm away from the surface in the sheet thickness direction is formed of a ferrite phase, the difference ΔD between an average grain size of the ferrite phase at the position 1 mm away from the surface in the sheet thickness direction and an average grain size of the ferrite phase at the sheet thickness center position is 2 μm or less, and the difference ΔV between a structural fraction (volume %) of a secondary phase at the position 1 mm away from the surface in the sheet thickness direction and the structural fraction (volume %) of the secondary phase at the sheet thickness center position is 2% or less.

When ΔD is 2 μm or less and ΔV is 2% or less, the low-temperature toughness, particularly DWTT characteristics and CTOD characteristics when a total thickness specimen is used are remarkably enhanced. When either ΔD or ΔV falls outside a desired range, the DWTT characteristics are deteriorated so that the low-temperature toughness is deteriorated.

From the above, the structure of the high-tensile-strength hot-rolled steel sheet is optionally limited to the structure where the primary phase of the structure at the position 1 mm away from the surface in the sheet thickness direction is formed of a ferrite phase, the difference ΔD between an average grain size of the ferrite phase at the position 1 mm away from the surface in the sheet thickness direction and an average grain size of the ferrite phase at the sheet thickness center position is 2 μm or less, and the difference ΔV between a structural fraction (volume %) of a secondary phase at the position 1 mm away from the surface in the sheet thickness direction and the structural fraction (volume %) of the secondary phase at the sheet thickness center position is 2% or less.

Mode of First Embodiment of the Present Invention

With respect to the hot-rolled steel sheet having TS of 510 MPa or more and sheet thickness of 11 mm or more, accelerated cooling is constituted of primary accelerated cooling and secondary accelerated cooling. The primary accelerated cooling and the secondary accelerated cooling may be continuously performed, or air cooling treatment which is performed within 10 s may be provided between the primary accelerated cooling and the secondary accelerated cooling. By performing the air cooling treatment between the primary accelerated cooling and the secondary accelerated cooling, overcooling of a surface layer can be prevented. Accordingly, the formation of martensite can be prevented. Air cooling time is preferably set to 10 s or less from a viewpoint of preventing a sheet-thickness inner portion from staying in a high temperature range.

The accelerated cooling is performed at a cooling rate of 10° C./s or more in terms of an average cooling rate at the sheet thickness center position. The average cooling rate at the sheet thickness center position in the primary accelerated cooling is an average in a temperature range from 750° C. to a temperature at the time of primary cooling stop. Further, the average cooling rate at the sheet thickness center position in the secondary accelerated cooling is an average in a temperature range from the temperature at the time of primary cooling stop to a temperature at a time of secondary cooling stop.

When the average cooling rate at the sheet thickness center position is less than 10° C./s, high-temperature transformed ferrite (polygonal ferrite) is liable to be formed so that a precipitation fraction of the secondary phase is increased at the sheet-thickness center portion whereby the above-mentioned desired structure cannot be formed. Accordingly, the accelerated cooling after completing the hot rolling is performed at the cooling rate of 10° C./s or more in terms of the average cooling rate at the sheet thickness center position. The cooling rate is preferably 20° C./s or more. To avoid the formation of polygonal ferrite, the accelerated cooling is preferably performed at the cooling rate of 10° C./s or more in a temperature range from 750 to 650° C. particularly.

In the primary accelerated cooling, the accelerated cooling is provided in such a manner that the cooling rate falls within the above-mentioned range, and the cooling rate difference between the average cooling rate at the sheet thickness center position (sheet thickness center portion) and the average cooling rate at the position 1 mm away from the surface in the sheet thickness direction (surface layer) is adjusted to less than 80° C./s. The average cooling rate is an average between a rolling completion temperature of finish rolling and a primary cooling stop temperature. By performing the accelerated cooling where the cooling rate difference in the primary accelerated cooling between the surface layer and the sheet thickness center portion is adjusted to less than 80° C./s, bainite or bainitic ferrite is formed particularly in the vicinity of the surface layer and hence, the hot-rolled steel sheet can secure desired strength-ductility balance without deteriorating ductility. On the other hand, in the accelerated cooling where the cooling rate difference between the sheet thickness center portion and the surface layer portion is increased exceeding 80° C./s, the structure in the vicinity of the surface layer and also the structure in a region up to 5 mm in the sheet thickness direction are liable to become the structure which contains a martensite phase and hence, ductility is deteriorated. In view of the above, the primary accelerated cooling is adjusted such that the cooling rate is 10° C./s or more in terms of an average cooling rate at the sheet thickness center position, and the cooling rate difference between the average cooling rate at the sheet thickness center position and the average cooling rate at the position 1 mm away from the surface in the sheet thickness direction is less than 80° C./s. Such primary accelerated cooling can be achieved by adjusting water quantity density of cooling water.

Further, the secondary accelerated cooling which is applied after the above-mentioned primary accelerated cooling is applied is the cooling which is performed at a cooling rate which falls within the above-mentioned range (a cooling rate of 10° C./s or more in terms of the average cooling rate at the sheet thickness center position) and with the cooling rate difference between the average cooling rate at the sheet thickness center position and the average cooling rate at the position 1 mm away from the surface in the sheet thickness direction being set to 80° C./s or more until the temperature at the sheet thickness center position becomes a secondary cooling stop temperature BFS defined by the following formula (2) or below.

$$BFS(°\,C.)=770-300C-70Mn-70Cr-170Mo-40Cu-40Ni-1.5CR \quad (2)$$

(Here, C, Ti, Nb, Mn, Cr, Mo, Cu, Ni: contents of respective elements (mass %), CR: cooling rate (° C./s)) When the cooling rate difference between the average cooling rate at the sheet thickness center position and the average cooling rate at the position 1 mm away from the surface in the sheet thickness direction in the secondary accelerated cooling is less than 80° C./s, the structure of the sheet thickness center portion cannot be turned into the desired structure (the structure formed of any one of a bainitic ferrite phase, a bainite phase or the mixture structure of the bainitic ferrite phase and the bainite phase which have sufficient ductility). Further, when the secondary cooling stop temperature exceeds BFS, polygonal ferrite is formed so that a structural fraction of a secondary phase is increased whereby desired characteristic cannot be secured. Accordingly, the secondary accelerated cooling is performed such that the cooling where the cooling rate difference between the average cooling rate at the sheet thickness center position and the average cooling rate at the position 1 mm away from the surface in the sheet thickness direction is 80° C./s or more is performed until the secondary cooling stop temperature which is BFS or below in terms of the temperature at the sheet thickness center position is obtained. The secondary cooling stop temperature is more preferably (BFS−20° C.) or below.

After the secondary accelerated cooling is stopped at the above-mentioned secondary cooling stop temperature or below, the hot-rolled sheet is coiled in a coil shape at a coiling temperature of BFS0 or below. The coiling temperature is more preferably (BFS0−20° C.) or below. BFS0 is defined by the following formula (3)

$$BFS0(°\,C.)=770-300C-70Mn-70Cr-170Mo-40Cu-40Ni \quad (3)$$

(Here, C, Mn, Cr, Mo, Cu, Ni: contents of respective elements (mass %))

By only setting the cooling stop temperature in the secondary accelerated cooling to the temperature of BFS or below and the coiling temperature to the temperature of BFS0 or below, as shown in FIG. 2 and FIG. 3, ΔD becomes 2 μm or less and ΔV becomes 2% or less and hence, the uniformity of the structure in the sheet thickness direction can be enhanced remarkably. Accordingly, it is possible to manufacture the thick high-tensile-strength hot-rolled steel sheet which can secure the excellent DWTT characteristics and the excellent CTOD characteristics thus remarkably enhancing the low-temperature toughness.

It is preferable to perform the secondary accelerated cooling such that the difference between the cooling stop temperature at the position 1 mm away from the surface in the sheet thickness direction and the coiling temperature (the temperature at the sheet thickness center position) at the time of the secondary cooling stop falls within 300° C. When the difference between the cooling stop temperature at the position 1 mm away from the surface in the sheet thickness direction and the coiling temperature is increased exceeding 300° C., the composite structure containing a martensite phase is formed in a surface layer depending on the composition of steel so that ductility is deteriorated whereby there may be a case where the desired strength-ductility balance cannot be secured. Accordingly, it is preferable to perform the secondary accelerated cooling such that the difference between the cooling stop temperature at the position 1 mm away from the surface in the sheet thickness direction and the coiling temperature (the temperature at the sheet thickness center position) falls within 300° C. The adjustment of such secondary accelerated cooling can be achieved by adjusting water quantity density or selecting a cooling bank.

Although an upper limit of the cooling rate is decided depending on an ability of a cooling device in use, it is preferable to set the upper limit of the cooling rate lower than a martensite forming cooling rate which is a cooling rate which does not cause the deterioration of a shape of a steel sheet such as warping. Further, such a cooling rate can be achieved by cooling which makes use of a flat nozzle, a bar nozzle, a circular tube nozzle or the like. In the present invention, as the temperature of the sheet thickness center portion, the cooling rate and the like, values which are calculated by the heat transfer calculation or the like are used.

The hot-rolled sheet coiled in a coil shape is preferably cooled to a room temperature at a cooling rate of 20 to 60° C./hr at the coil center portion. When the cooling rate is less than 20° C./hr, the growth of crystal grains progresses thus giving rise to a possibility that toughness is deteriorated. On the other hand, when the cooling rate exceeds 60° C./hr, the temperature difference between a coil center portion and a coil outer peripheral portion or an inner peripheral portion is increased so that a shape of the coil is liable to be deteriorated.

The thick high-tensile-strength hot-rolled steel sheet obtained by the above-mentioned manufacturing method has the above-mentioned composition, and has the structure where at least the structure of the primary phase at the position 1 mm away from the surface in the sheet thickness direction is formed of a ferrite phase. Here, unless otherwise specified, "ferrite" means hard low-temperature transformed ferrite (bainitic ferrite, bainite or a mixture phase of bainitic ferrite and bainite). "ferrite" does not include soft high-temperature transformed ferrite (granular polygonal ferrite) in its concept. As the secondary phase, any one of perlite, martensite, MA, upper bainite or a mixture phase formed of two or more kinds of these ferrites can be listed. It is needless to say that, in the thick high-tensile-strength hot-rolled steel sheet, the structure at the sheet thickness center position is also formed of the substantially same structure where the ferrite phase constitutes the primary phase.

Further, the thick high-tensile-strength hot-rolled steel sheet obtained by the above-mentioned manufacturing method has the structure where the difference ΔD between an average grain size of the ferrite phase at the position 1 mm away from the surface of the steel sheet in the sheet thickness direction and an average grain size (μm) of the ferrite phase at the sheet thickness center position is 2 μm or less, and the difference ΔV between a structural fraction (volume %) of a secondary phase at the position 1 mm away from the surface in the sheet thickness direction and the structural fraction (volume %) of the secondary phase at the sheet thickness center position is 2% or less.

Only when ΔD is 2 μm or less and ΔV is 2% or less, the low-temperature toughness, particularly DWTT characteristics and CTOD characteristics of the thick high-tensile-strength hot-rolled steel sheet when a total thickness specimen is used are remarkably enhanced. When either ΔD or ΔV falls outside a desired range, as can be clearly understood from FIG. 1, DWTT becomes higher than −35° C. so that the DWTT characteristics are deteriorated whereby the low-temperature toughness is deteriorated. From the above, the structure of the thick high-tensile-strength hot-rolled steel sheet is optionally limited to the structure where the difference ΔD between an average grain size of the ferrite phase at the position 1 mm away from the surface of the steel sheet in the sheet thickness direction and an average grain size (μm) of the ferrite phase at the sheet thickness center position is 2 μm or less, and the difference ΔV between a structural fraction (volume %) of a secondary phase at the position 1 mm away from the surface in the sheet thickness direction and the structural fraction (volume %) of the secondary phase at the sheet thickness center position is 2% or less. Due to such composition and structure, it is possible to manufacture the steel sheet which possesses the excellent strength-ductility balance.

It is confirmed that the hot-rolled steel sheet having the structure where ΔD is 2 μm or less and ΔV is 2% or less satisfies the condition that the difference ΔD* in average grain size (μm) of the ferrite phase between a position 1 mm away from a surface of a steel sheet in the sheet thickness direction and a position away from the surface of the steel sheet by ¼ of the sheet thickness is 2 μm or less, the difference ΔV* in a structural fraction (%) of the secondary phase is 2% or less, or the condition that the difference ΔD in average grain size (μm) of the ferrite phase between a position 1 mm away from a surface of a steel sheet in the sheet thickness direction and a position away from the surface of the steel sheet by ¾ of the sheet thickness is 2 μm or less, and the difference ΔV of a structural fraction (%) of the secondary phase is 2% or less.

Hereinafter, the present invention is further explained in detail in conjunction with examples.

Example 1

The example of the first embodiment of the present invention of the present invention relating to the hot-rolled steel sheet having TS of 510 MPa or more and the sheet thickness of 11 mm or more is explained hereinafter.

Slabs (raw steel materials) having the compositions shown in Table 1 (thickness: 215 mm) are subjected to hot rolling under hot rolling conditions shown in Table 2-1 and Table 2-2. After hot rolling is completed, the hot-rolled sheet are cooled under cooling conditions shown in Table 2-1 and Table 2-2, and are coiled in a coil shape at coiling temperatures shown in Table 2-1 and Table 2-2, and are turned into hot-rolled steel sheets (steel strips) having sheet thicknesses shown in Table 2-1 and Table 2-2. Using these hot-rolled steel sheets as raw materials, open pipes are formed by roll continuous forming by cold rolling, and end surfaces of the open pipes are welded together by electric resistance welding thus manufacturing an electric resistance welded steel pipe (outer diameter: 660 mmϕ).

Specimens are sampled from the obtained hot-rolled steel sheets, and the observation of structure, a tensile test, an impact test, a DWTT test and a CTOD test are carried out with respect to these specimens. The DWTT test and the CTOD test are also carried out with respect to the electric resistance welded steel pipe. The following test methods are used.

(1) Observation of Structure

A structure-observation-use specimen is sampled from the obtained hot-rolled steel sheet, a cross-section of the specimen in the rolling direction is polished and etched. The cross section is observed and is imaged, and a kind of the structure is identified for each specimen with two visual fields or more using an optical microscope (magnification: 1000 times) or a scanning electron microscope (magnification: 2000 times). Further, using an image analyzer, an average grain size of a ferrite phase and a structural fraction (volume %) of a secondary phase other than the ferrite phase are measured. Observation positions are set to a position 1 mm away from a surface of the steel sheet in the sheet thickness direction and a sheet thickness center portion. The average grain size of the ferrite phase is obtained such that an area of each ferrite grain is measured, a circle equivalent diameter is calculated from the area, an arithmetic average of circle equivalent diameters of the obtained respective ferrite grains is obtained, and the arithmetic average at the position is set as the average grain size.

(2) Tensile Strength Test

A plate-shaped specimen (width of flat portion: 12.5 mm, gauge length: 50 mm) is sampled from the obtained hot-rolled steel sheet such that the longitudinal direction is taken along the direction orthogonal to the rolling direction (C direction), and a tensile test is carried out with respect to the specimen in accordance with provisions of ASTM E 8 at a room temperature thus obtaining tensile strength TS and elongation El, and the strength-ductility balance TS×El is calculated.

(3) Impact Test

V notch specimens are sampled from a sheet thickness center portion of the obtained hot-rolled steel sheet such that the longitudinal direction is taken in the direction orthogonal to the rolling direction (C direction), and a Charpy impact test is carried out in accordance with provisions of JIS Z 2242 thus obtaining absorbed energy (J) at a test temperature of −80° C. The number of specimens is three and an arithmetic average of the obtained absorbed energy values is obtained, and the arithmetic average is set as an absorbed energy value $vE_{-80}$(J) of the steel sheet. The evaluation "favorable toughness" is given when $vE_{-80}$ is 300 J or more.

(4) DWTT Test

DWTT specimens (size: sheet thickness×width of 3 in.× length of 12 in.) are sampled from the obtained hot-rolled steel sheet such that the longitudinal direction is taken in the direction orthogonal to the rolling direction (C direction), and a DWTT test is carried out in accordance with provisions of ASTM E 436 thus obtaining the lowest temperature (DWTT) at which percent ductile fracture becomes 85%. The evaluation "excellent DWTT characteristics" is given when the DWTT is −35° C. or below.

In the DWTT test, DWTT specimens are also sampled from a parent material portion of an electric resistance welded steel pipe such that the longitudinal direction of the specimen becomes the pipe circumferential direction, and the test is carried out in the same manner as the steel sheet.

(5) CTOD Test

CTOD specimens (size: sheet thickness×width (2×sheet thickness)×length (10×sheet thickness)) are sampled from the obtained hot-rolled steel sheet such that the longitudinal direction is taken in the direction orthogonal to the rolling direction (C direction), and the CTOD test is carried out in accordance with provisions of ASTM E 1290 at the test temperature of −10° C. thus obtaining a crack tip opening displacement amount (CTOD value) at a temperature of −10° C. A test force is loaded based on a three point bending method, a displacement gauge is mounted on a notched portion, and crack tip opening displacement amount CTOD value is obtained. The evaluation "excellent CTOD characteristics" is given when the CTOD value is 0.30 mm or more.

In the CTOD test, CTOD specimens are also sampled from an electric resistance welded steel pipe such that the longitudinal direction of the specimen is taken in the direction orthogonal to the pipe axial direction, a notch is formed in a parent material portion and a seam portion, and the CTOD test is carried out in the same manner as the steel sheet.

Obtained results are shown in Table 3-1 and Table 3-2.

All examples of the present invention provide hot-rolled steel sheets which have the proper structure, high strength with TS of 510 MPa or more and the excellent low-temperature toughness in which $vE_{-80}$ is 300 J or more, the CTOD value is 0.30 mm or more and DWTT is −35° C. or below, and also has the excellent strength-ductility balance of TS×El: 18000 MPa % or more. Further, the electric resistance welded steel pipe manufactured using the hot-rolled steel sheet of the example of the present invention also forms the steel pipe having the excellent low-temperature toughness in which the both parent material portion and the seam portion have a CTOD value of 0.30 mm or more and DWTT of −20° C. or below.

On the other hand, in comparison examples, $vE_{-80}$ is less than 300 J, the CTOD value is less than 0.30 mm or DWTT exceeds −35° C. and hence, the low-temperature toughness is deteriorated or the elongation is low so that the strength-ductility balance of a desired value cannot be secured.

TABLE 1

| steel No. | chemical component (mass %) C | Si | Mn | P | S | Al | Nb | Ti | N | O | V, Mo, Cr, Cu, Ni | Ca | left-side value in formula(1)* | remarks |
|---|---|---|---|---|---|---|---|---|---|---|---|---|---|---|
| A | 0.043 | 0.22 | 1.15 | 0.016 | 0.0022 | 0.035 | 0.049 | 0.009 | 0.0022 | 0.0032 | Mo: 0.18 | — | 0.8 | example of present invention |
| B | 0.032 | 0.24 | 1.43 | 0.016 | 0.0019 | 0.039 | 0.054 | 0.014 | 0.0025 | 0.0035 | — | — | 1.3 | example of present invention |
| C | 0.061 | 0.21 | 1.59 | 0.014 | 0.0023 | 0.035 | 0.061 | 0.012 | 0.0030 | 0.0031 | — | — | 0.7 | example of present invention |
| D | 0.039 | 0.23 | 1.41 | 0.010 | 0.0010 | 0.036 | 0.063 | 0.012 | 0.0033 | 0.0033 | Mo: 0.16, Cu: 0.23, Ni: 0.24 | 0.0022 | 1.1 | example of present invention |

TABLE 1-continued

| steel No. | C | Si | Mn | P | S | Al | Nb | Ti | N | O | V, Mo, Cr, Cu, Ni | Ca | left-side value in formula(1)* | remarks |
|---|---|---|---|---|---|---|---|---|---|---|---|---|---|---|
| | chemical component (mass %) | | | | | | | | | | | | | |
| E | 0.041 | 0.19 | 1.63 | 0.014 | 0.0025 | 0.039 | 0.061 | 0.011 | 0.0028 | 0.0029 | Mo: 0.16, Cu: 0.18, Mo: 0.1 | — | 0.9 | example of present invention |
| F | 0.049 | 0.22 | 1.61 | 0.015 | 0.0028 | 0.030 | 0.061 | 0.014 | 0.0025 | 0.0027 | Cr: 0.32 | — | 0.9 | example of present invention |
| G | 0.039 | 0.20 | 1.76 | 0.017 | 0.0014 | 0.034 | 0.064 | 0.009 | 0.0033 | 0.0029 | V: 0.056, Cu: 0.25, Ni: 0.25 | 0.0020 | 1.1 | example of present invention |
| H | 0.037 | 0.39 | 1.61 | 0.018 | 0.0016 | 0.035 | 0.071 | 0.019 | 0.0025 | 0.0037 | V: 0.049, Cu: 0.24, Ni: 0.21, Mo: 0.23 | 0.0018 | 1.5 | example of present invention |
| I | 0.024 | 0.51 | 1.35 | 0.016 | 0.0022 | 0.039 | 0.190 | 0.040 | 0.0037 | 0.0031 | — | — | 5.6 | comparison example |

*left-side value in formula(1) = (Ti + Nb/2)C

TABLE 2-1

| steel sheet No. | steel No. | hot rolling: heating temperature (° C.) | hot rolling: finish rolling start temperature (° C.) | hot rolling: finish rolling finish temperature (° C.) | hot rolling: effective reduction ratio (%) | cooling after hot rolling: primary cooling: cooling start temperature (° C.) | cooling after hot rolling: primary cooling: cooling rate difference* (° C./s) | cooling after hot rolling: primary cooling: cooling rate at sheet thickness center (° C./s) | cooling after hot rolling: primary cooling: cooling stop temperature*** (° C.) | cooling after hot rolling: air cooling: air cooling time (s) |
|---|---|---|---|---|---|---|---|---|---|---|
| 1 | A | 1200 | 970 | 790 | 58 | 808 | 75 | 22 | 535 | — |
| 2 | A | 1200 | 980 | 780 | 28 | 798 | 60 | 18 | 600 | — |
| 3 | A | 1210 | 980 | 785 | 52 | 803 | 450 | 57 | 400 | — |
| 4 | B | 1220 | 970 | 790 | 48 | 808 | 35 | 13 | 600 | — |
| 5 | B | 1220 | 970 | 790 | 48 | 808 | 15 | 10 | 650 | — |
| 6 | B | 1220 | 970 | 790 | 56 | 808 | 35 | 13 | 620 | — |
| 7 | C | 1200 | 980 | 780 | 49 | 798 | 76 | 21 | 610 | — |
| 8 | C | 1200 | 970 | 790 | 49 | 800 | 35 | 14 | 650 | — |
| 9 | D | 1210 | 980 | 785 | 53 | 803 | 67 | 20 | 615 | — |
| 10 | D | 1210 | 975 | 785 | 53 | 802 | 46 | 16 | 620 | — |
| 11 | E | 1200 | 960 | 780 | 59 | 798 | 75 | 21 | 680 | — |
| 12 | E | 1200 | 960 | 780 | 59 | 798 | 262 | 43 | 460 | — |

| steel sheet No. | cooling after hot rolling secondary cooling: cooling rate difference** (° C./s) | cooling after hot rolling secondary cooling: cooling rate at sheet thickness center (° C./s) | cooling after hot rolling secondary cooling: cooling stop temperature**** (° C.) | cooling after hot rolling secondary cooling: temperature difference***** (° C.) | coiling: coiling temperature (° C.) | BFS (° C.) | BFS0 (° C.) | sheet thickness (mm) | remarks |
|---|---|---|---|---|---|---|---|---|---|
| 1 | 416 | 75 | 480 | 202 | 455 | 534 | 646 | 12.7 | example of present invention |
| 2 | 107 | 35 | 500 | 245 | 495 | 594 | 646 | 12.7 | example of present invention |
| 3 | 166 | 45 | 500 | 233 | 495 | 579 | 646 | 12.7 | comparison example |
| 4 | 86 | 25 | 520 | 261 | 510 | 623 | 660 | 17.5 | example of present invention |
| 5 | 104 | 28 | 500 | 238 | 480 | 618 | 660 | 17.5 | example of present invention |
| 6 | 299 | 52 | 580 | 438 | 670 | 582 | 660 | 17.5 | comparison example |
| 7 | 96 | 23 | 520 | 253 | 500 | 606 | 640 | 22.2 | example of present invention |
| 8 | 10 | 5 | 490 | 236 | 480 | 633 | 640 | 22.2 | comparison example |
| 9 | 166 | 32 | 540 | 296 | 530 | 566 | 614 | 22.2 | example of present invention |
| 10 | 83 | 21 | 600 | 336 | 600 | 583 | 614 | 22.2 | comparison example |
| 11 | 355 | 50 | 420 | 154 | 410 | 527 | 602 | 22.2 | example of present invention |
| 12 | 262 | 42 | 400 | 173 | 400 | 539 | 602 | 22.2 | comparison example |

*average cooling rate at sheet thickness center position and position 1 mm away from surface in the sheet thickness direction (temperature range from 750° C. to temperature at primary cooling stop time)

**average cooling rate difference between sheet thickness center position and position 1 mm away from surface in the sheet thickness direction (temperature range from temperature at primary cooling stop time to temperature at secondary cooling stop time)

***cooling stop temperature at position 1 mm away from surface in sheet thickness direction

****cooling stop temperature at sheet thickness center position

*****temperature difference between secondary cooling stop temperature (at position 1 mm away from surface in the sheet thickness direction) and coiling temperature (at sheet thickness center position)

TABLE 2-2

| steel sheet No. | steel No. | hot rolling: heating temperature (° C.) | hot rolling: finish rolling start temperature (° C.) | hot rolling: finish rolling finish temperature (° C.) | hot rolling: effective reduction ratio (%) | cooling after hot rolling: primary cooling: cooling start temperature (° C.) | cooling after hot rolling: primary cooling: cooling rate difference* (° C./s) | cooling after hot rolling: primary cooling: cooling rate at sheet thickness center (° C./s) | cooling after hot rolling: primary cooling: cooling stop temperature*** (° C.) | cooling after hot rolling: air cooling: air cooling time (s) |
|---|---|---|---|---|---|---|---|---|---|---|
| 13 | F | 1200 | 960 | 790 | 58 | 808 | 73 | 20 | 510 | — |
| 14 | F | 1200 | 960 | 795 | 57 | 807 | 563 | 64 | 505 | — |
| 15 | G | 1200 | 960 | 780 | 48 | 798 | 64 | 19 | 650 | — |
| 16 | G | 1200 | 960 | 780 | 48 | 798 | 63 | 19 | 655 | — |
| 17 | H | 1220 | 990 | 775 | 46 | 793 | 42 | 15 | 650 | — |
| 18 | H | 1220 | 980 | 775 | 46 | 793 | 190 | 36 | 600 | — |
| 19 | I | 1230 | 1050 | 840 | 55 | 858 | 173 | 34 | 600 | — |
| 20 | A | 1200 | 980 | 780 | 58 | 808 | 75 | 22 | 535 | 0.5 |
| 21 | B | 1210 | 970 | 790 | 48 | 800 | 35 | 13 | 615 | 2 |
| 22 | C | 1170 | 960 | 780 | 49 | 800 | 55 | 17 | 630 | 5 |
| 23 | C | 1170 | 960 | 780 | 49 | 800 | 55 | 17 | 630 | 15 |

| steel sheet No. | cooling after hot rolling secondary cooling: cooling rate difference** (° C./s) | cooling after hot rolling secondary cooling: cooling rate at sheet thickness center (° C./s) | cooling after hot rolling secondary cooling: cooling stop temperature**** (° C.) | cooling after hot rolling secondary cooling: temperature difference***** (° C.) | coiling: coiling temperature (° C.) | BFS (° C.) | BFS0 (° C.) | sheet thickness (mm) | remarks |
|---|---|---|---|---|---|---|---|---|---|
| 13 | 339 | 45 | 470 | 238 | 465 | 553 | 620 | 25.4 | example of present invention |
| 14 | 561 | 60 | 470 | 210 | 465 | 530 | 620 | 25.4 | comparison example |
| 15 | 260 | 36 | 480 | 265 | 500 | 561 | 615 | 28.5 | example of present invention |
| 16 | 214 | 32 | 590 | 402 | 635 | 567 | 615 | 28.5 | comparison example |
| 17 | 190 | 32 | 450 | 219 | 445 | 541 | 589 | 25.4 | example of present invention |
| 18 | 12 | 5 | 450 | 200 | 445 | 582 | 589 | 25.4 | comparison example |
| 19 | 171 | 30 | 540 | 300 | 530 | 623 | 668 | 25.4 | comparison example |
| 20 | 410 | 70 | 480 | 200 | 455 | 534 | 646 | 12.7 | example of present invention |
| 21 | 96 | 23 | 520 | 252 | 500 | 626 | 660 | 17.5 | example of present invention |
| 22 | 87 | 22 | 490 | 236 | 480 | 607 | 640 | 22.2 | example of present invention |
| 23 | 100 | 25 | 490 | 236 | 480 | 603 | 640 | 22.2 | example of present invention |

*average cooling rate at sheet thickness center position and position 1 mm away from surface in the sheet thickness direction (temperature range from 750° C. to temperature at primary cooling stop time)

**average cooling rate difference between sheet thickness center position and position 1 mm away from surface in the sheet thickness direction (temperature range from temperature at primary cooling stop time to temperature at secondary cooling stop time)

***cooling stop temperature at position 1 mm away from surface in sheet thickness direction

****cooling stop temperature at sheet thickness center position

*****temperature difference between secondary cooling stop temperature (at position 1 mm away from surface in the sheet thickness direction) and coiling temperature (at sheet thickness center position)

TABLE 3-1

| steel sheet No. | steel No. | structure**: position 1 mm away from surface in the sheet thickness direction | structure**: sheet thickness center position | steel sheet structural difference in the sheet thickness direction*: difference ΔD in average grain size of ferrite (μm) | steel sheet structural difference in the sheet thickness direction*: structural fraction difference ΔV of second phase (vol. %) | tensile characteristics: TS (MPa) | tensile characteristics: EI (%) | tensile characteristics: TS × EI (MPa %) |
|---|---|---|---|---|---|---|---|---|
| 1 | A | F + BF | BF | 0.6 | 0.1 | 578 | 36 | 20808 |
| 2 | A | F + BF | F + BF | 0.4 | 0.1 | 573 | 37 | 21201 |
| 3 | A | B + M | BF | 0.2 | 6.5 | 628 | 27 | 16956 |
| 4 | B | F | BF | 0.5 | 0.2 | 579 | 34 | 19686 |
| 5 | B | F + BF | BF | 0.4 | 0.3 | 585 | 35 | 20475 |
| 6 | B | F + BF | BF + M | 0.5 | 5.4 | 602 | 33 | 19866 |
| 7 | C | F + BF | BF | 0.3 | 0.3 | 642 | 31 | 19902 |
| 8 | C | F + BF | F +MA | 1.2 | 3.9 | 652 | 33 | 21516 |
| 9 | D | F + BF | BF | 0.4 | 0.4 | 673 | 30 | 20190 |
| 10 | D | F + BF | F +M | 2.7 | 2.5 | 678 | 27 | 18306 |
| 11 | E | F + BF | BF | 0.5 | 0.4 | 692 | 30 | 20760 |
| 12 | E | B + M | BF | 0.5 | 2.6 | 714 | 23 | 16422 |
| 13 | F | F + BF | BF | 0.6 | 0.2 | 679 | 30 | 20370 |
| 14 | F | BF + M | BF | 0.2 | 2.5 | 699 | 24 | 16776 |
| 15 | G | F + BF | BF | 0.6 | 0.1 | 735 | 28 | 20580 |

TABLE 3-1-continued

| steel sheet No. | low-temperature toughness vE$_{-80}$ (J) | low-temperature toughness DWTT (° C.) | low-temperature toughness CTOD value (at −10° C.) (mm) | low-temperature toughness of steel pipe: parent material portion DWTT (° C.) | low-temperature toughness of steel pipe: parent material portion CTOD value (at −10° C.) (mm) | low-temperature toughness of steel pipe: seam portion CTOD value (at −10° C.) (mm) | remarks |
|---|---|---|---|---|---|---|---|
| 1 | 375 | −60 | 0.96 | −40 | 0.87 | 0.84 | example of present invention |
| 2 | 367 | −50 | 0.96 | −30 | 0.78 | 0.73 | example of present invention |
| 3 | 300 | −45 | 0.57 | −25 | 0.57 | 0.53 | comparison example |
| 4 | 320 | −50 | 0.87 | −30 | 0.82 | 0.77 | example of present invention |
| 5 | 310 | −40 | 0.89 | −20 | 0.79 | 0.76 | example of present invention |
| 6 | 320 | −10 | 0.25 | 10 | 0.26 | 0.25 | comparison example |
| 7 | 314 | −50 | 0.72 | −30 | 0.69 | 0.65 | example of present invention |
| 8 | 75 | −10 | 0.31 | 10 | 0.26 | 0.25 | comparison example |
| 9 | 302 | −50 | 0.76 | −30 | 0.54 | 0.53 | example of present invention |
| 10 | 173 | −30 | 0.72 | −10 | 0.65 | 0.61 | comparison example |
| 11 | 309 | −50 | 0.72 | −30 | 0.46 | 0.44 | example of present invention |
| 12 | 318 | −50 | 0.56 | −30 | 0.56 | 0.55 | comparison example |
| 13 | 327 | −60 | 0.62 | −30 | 0.57 | 0.56 | example of present invention |
| 14 | 310 | −45 | 0.35 | −25 | 0.32 | 0.31 | comparison example |
| 15 | 302 | −40 | 0.57 | −20 | 0.56 | 0.53 | example of present invention |

*structural difference between position 1 mm away from surface in the sheet thickness direction and sheet thickness center position
**F: ferrite, B: bainite, BF: bainitic ferrite, M: martensite, P: perlite, MA: island martensite

TABLE 3-2

| steel sheet No. | steel No. | structure**: position 1 mm away from surface in the sheet thickness direction | structure**: sheet thickness center position | steel sheet structural difference in the sheet thickness direction*: difference ΔD in average grain size of ferrite (μm) | steel sheet structural difference in the sheet thickness direction*: structural fraction difference ΔV of second phase (vol. %) | tensile characteristics: TS (MPa) | tensile characteristics: EI (%) | tensile characteristics: TS × EI (MPa %) |
|---|---|---|---|---|---|---|---|---|
| 16 | G | F + BF | F + BF + MA | 1.8 | 2.9 | 752 | 29 | 21808 |
| 17 | H | F + BF | BF | 0.7 | 0.9 | 783 | 27 | 21141 |
| 18 | H | BF + M | F + BF + MA | 1.7 | 2.7 | 751 | 22 | 16522 |
| 19 | I | F | F | 1.2 | 0.1 | 643 | 32 | 20576 |
| 20 | A | F + BF | BF | 0.6 | 0.1 | 577 | 35 | 20195 |
| 21 | B | F + BF | BF | 0.5 | 0.3 | 580 | 34 | 19720 |
| 22 | C | F + BF | BF | 0.5 | 0.5 | 647 | 32 | 20704 |
| 23 | C | F + BF | BF + M | 1 | 1.5 | 645 | 32 | 20640 |

| steel sheet No. | low-temperature toughness vE$_{-80}$ (J) | low-temperature toughness DWTT (° C.) | low-temperature toughness CTOD value (at −10° C.) (mm) | low-temperature toughness of steel pipe: parent material portion DWTT (° C.) | low-temperature toughness of steel pipe: parent material portion CTOD value (at −10° C.) (mm) | low-temperature toughness of steel pipe: seam portion CTOD value (at −10° C.) (mm) | remarks |
|---|---|---|---|---|---|---|---|
| 16 | 85 | −10 | 0.29 | 10 | 0.28 | 0.26 | comparison example |
| 17 | 312 | −35 | 0.43 | −15 | 0.45 | 0.45 | example of present invention |
| 18 | 42 | 0 | 0.19 | 20 | 0.15 | 0.11 | comparison example |
| 19 | 363 | −50 | 0.89 | −30 | 0.74 | 0.07 | comparison example |
| 20 | 369 | −60 | 0.97 | −40 | 0.82 | 0.82 | example of present invention |
| 21 | 307 | −45 | 0.82 | −25 | 0.8 | 0.72 | example of present invention |
| 22 | 298 | −45 | 0.7 | −25 | 0.75 | 0.78 | example of present invention |
| 23 | 247 | −35 | 0.65 | −15 | 0.72 | 0.71 | example of present invention |

*structural difference between position 1 mm away from surface in the sheet thickness direction and sheet thickness center position
**F: ferrite, B: bainite, BF: bainitic ferrite, M: martensite, P: perlite, MA: island martensite Mode of Second Embodiment of the Present Embodiment The extra thick high-tensile-strength hot-rolled steel sheet having TS of 530 MPa or more and a sheet thickness exceeding 22 mm has the above-mentioned composition, and has the structure where an average grain size of a ferrite phase at the sheet thickness center position is 5 μm or less and a structural fraction (volume %) of a secondary phase is 2% or less, the difference ΔD between an average grain size of the ferrite phase at the position 1 mm away from the surface of the steel sheet in the sheet thickness direction and an average grain size of the ferrite phase at the sheet thickness center position is 2 μm or less, and the difference ΔV between a structural fraction (volume %) of a secondary phase at the position 1 mm away from the surface in the sheet thickness direction and the structural fraction (volume %) of the secondary phase at the sheet thickness center position is 2% or less. Here, unless otherwise specified, "ferrite" means hard low-temperature transformed ferrite (bainitic ferrite, bainite or a mixture phase of bainitic ferrite and bainite). "Ferrite" does not include soft high-temperature transformed ferrite (granular polygonal ferrite) in its concept. Further, as the secondary phase, one of perlite, martensite, MA, upper bainite or a mixture phase formed of two or more kinds of these ferrites can be listed. With respect to the structure at the sheet thickness center position, a primary phase is formed of any one of a bainitic ferrite phase, a bainite phase and a mixture phase of the bainitic ferrite phase and the bainite phase, and as a secondary phase, any one of perlite, martensite, island martensite (MA), upper bainite or a mixture phase formed of two or more kinds of these ferrites can be listed.

When ΔD is 2 μm or less and ΔV is 2% or less, the low-temperature toughness, particularly DWTT characteristics and CTOD characteristics when a total thickness specimen is used are remarkably enhanced. When either ΔD or ΔV falls outside a desired range, the DWTT characteristics are deteriorated so that the low-temperature toughness is deteriorated. Further, when the sheet thickness is extra large exceeding 22 mm, it is advantageous to set an average grain size of a ferrite phase to 5 μm or less and a structural fraction (volume %) of a secondary phase to 2% or less at the sheet thickness center position. When the average grain size of the ferrite phase exceeds 5 μm or when the structural fraction (volume %) of the secondary phase exceeds 2%, the DWTT characteristics are deteriorated so that the low-temperature toughness is deteriorated.

From the above, in the second embodiment of the present invention of the present invention, the structure of the extra thick high-tensile-strength hot-rolled steel sheet is optionally limited to the structure where the average grain size of the ferrite phase at the sheet thickness center position is 5 μm or less and the structural fraction (volume %) of a secondary phase is 2% or less, the difference ΔD between an average grain size of the ferrite phase at the position 1 mm away from the surface of the steel sheet in the sheet thickness direction and an average grain size (μm) of the ferrite phase at the sheet thickness center position is 2 μm or less, and the difference Δv between a structural fraction (volume %) of a secondary phase at the position 1 mm away from the surface in the sheet thickness direction and the structural fraction (volume %) of the secondary phase at the sheet thickness center position is 2% or less.

It is confirmed that the hot-rolled steel sheet having the structure where ΔD is 2 μm or less and ΔV is 2% or less satisfies the condition that the difference ΔD* in average grain size (μm) of the ferrite phase between a position 1 mm away from a surface of a steel sheet in the sheet thickness direction and a position away from the surface of the steel sheet by ¼ of the sheet thickness is 2 μm or less, and the difference ΔV* of a structural fraction (%) of the secondary phase is 2% or less, or the condition that the difference ΔD in average grain size (μm) of the ferrite phase between a position 1 mm away from the surface of the steel sheet in the sheet thickness direction and a position away from the surface of the steel sheet by ¾ of the sheet thickness is 2 μm or less, and the difference ΔV of a structural fraction (%) of the secondary phase is 2% or less.

In the example of the hot-rolled steel sheet having TS of 530 MPa or more and the sheet thickness exceeding 22 mm, after completing the hot rolling (finish rolling), accelerated cooling is applied to the hot-rolled sheet on a hot run table. To set the grain size of the ferrite phase at the sheet thickness center position to a predetermined value or less and the structural fraction of the secondary phase to 2% or less by volume %, a holding time during which a temperature of the hot-rolled steel sheet at the sheet thickness center position reaches a temperature (T−20° C.) from a temperature T(° C.) which is a temperature at starting the accelerated cooling after completing the finish rolling is set to a value within 20 s so that the holding time at a high temperature is shortened. When the holding time during which the temperature becomes from T(° C.) to (T−20° C.) is long exceeding 20 s, a grain size at the time of transformation is liable to become coarse so that it is difficult to avoid the formation of high-temperature transformed ferrite (polygonal ferrite). To set the holding time during which the temperature becomes from T(° C.) to (T−20° C.) within 20 s, a sheet passing speed on the hot run table is preferably set to 120 mpm or more within a sheet thickness range of the steel sheet.

Further, it is preferable to start the accelerated cooling when a temperature of the sheet thickness center portion is still 750° C. or above. When the temperature of the sheet thickness center portion becomes below 750° C., high-temperature transformed ferrite (polygonal ferrite) is formed so that C discharged at the time of transformation from γ to α is concentrated into non-transformed γ whereby a secondary phase constituted of a perlite phase, upper bainite or the like is formed around the polygonal ferrite. Accordingly, a structural fraction of the secondary phase at the sheet thickness center portion is increased and hence, the above-mentioned desired structure cannot be obtained.

It is preferable to perform the accelerated cooling up to the cooling stop temperature below BFS at a cooling rate of 10° C./s or more, preferably at a cooling rate of 20° C./s or more in terms of an average cooling rate at the sheet thickness center portion.

When the cooling rate at the sheet thickness center position is less than 10° C./s, high-temperature transformed ferrite (polygonal ferrite) is liable to be formed so that a structural fraction of the secondary phase at the sheet thickness center portion is increased whereby the above-mentioned desired structure cannot be formed. Accordingly, the accelerated cooling after completing the hot rolling is preferably performed at the cooling rate of 10° C./s or more in terms of the average cooling rate at the sheet thickness center portion. Although an upper limit of the cooling rate is decided depending on an ability of a cooling device in use, it is preferable to set the upper limit of the cooling rate lower than a martensite forming cooling rate which is a cooling rate which does not cause the deterioration of a shape of a steel sheet such as warping. Further, such a cooling rate can be achieved by a water-cooling device which makes use of a flat nozzle, a bar nozzle, a circular tube nozzle or the like. As the temperature at the sheet thickness center portion, the cooling rate and the like, values which are calculated by the heat transfer calculation or the like are used.

It is preferable to set the above-mentioned cooling stop temperature of the accelerated cooling to BFS or below in terms of a temperature at a sheet thickness center position. It is more preferable to set the above-mentioned cooling stop temperature of the accelerated cooling to (BFS−20° C.) or below. The BFS is defined by the following formula (2).

$$BFS(°\,C.)=770-300C-70Mn-70Cr-170Mo-40Cu-40Ni-1.5CR \quad (2)$$

(Here, C, Mn, Cr, Mo, Cu, Ni: contents of respective elements (mass %), CR: cooling rate (° C./s))

To set a grain size of the ferrite phase at the sheet thickness center position to a predetermined value or less and the structural fraction of the secondary phase to 2% or less by volume %, further, the above-mentioned cooling time from the cooling start point T(° C.) to the BFS temperature is adjusted to 30 s or less. When the cooling time from T(° C.) to the BFS temperature is prolonged exceeding 30 s, high-temperature transformed ferrite (polygonal ferrite) is liable to be formed so that C discharged at the time of transformation from γ to α is concentrated into non-transformed γ whereby a secondary phase constituted of a perlite phase, upper bainite or the like is formed around the polygonal ferrite. Accordingly, a structural fraction of the secondary phase at the sheet thickness center portion is increased and hence, the above-mentioned desired structure cannot be obtained. In view of the above, the cooling time from the cooling start point T(° C.) to the BFS temperature is optionally limited to 30 s or less. The adjustment of the cooling time from the cooling start point T(° C.) to the BFS temperature can be realized through the adjustment of a sheet passing speed and the adjustment of cooling water quantity.

After the accelerated cooling is stopped at the above-mentioned cooling stop temperature or below, the hot-rolled sheet is coiled in a coil shape at a coiling temperature of BFS0 or below in terms of a temperature at a sheet thickness center position. The coiling temperature is more preferably (BFS0−20° C.) or below. BFS0 is defined by the following formula (3)

$$BFS0(°\,C.)=770-300C-70Mn-70Cr-170Mo-40Cu-40Ni \quad (3)$$

(Here, C, Mn, Cr, Mo, Cu, Ni: contents of respective elements (mass %))

By setting the cooling stop temperature in the accelerated cooling to the temperature of BFS or below and the coiling temperature to the temperature of BFS0 or below, AD becomes 2 μm or less and ΔV becomes 2% or less and hence, the uniformity of the structure in the sheet thickness direction can be enhanced remarkably. Accordingly, the extra thick high-tensile-strength hot-rolled steel sheet can secure the excellent DWTT characteristics and the excellent CTOD characteristics.

Example 2

The example of the hot-rolled steel sheet having TS of 530 MPa or more and the sheet thickness exceeding 22 mm is explained hereinafter.

Slabs (raw steel materials) having the compositions shown in Table 4 (thickness: 230 mm) are subjected to hot rolling under hot rolling conditions shown in Table 5. After hot rolling is completed, the hot-rolled sheets are cooled under cooling conditions shown in Table 5, and are coiled in a coil shape at coiling temperatures shown in Table 5, and are turned into hot-rolled steel sheets (steel strips) having sheet thicknesses shown in Table 5. Using these hot-rolled steel sheets as raw materials, open pipes are formed by roll continuous forming by cold forming, and end surfaces of the open pipes are welded together by electric resistance welding thus manufacturing an electric resistance welded steel pipe (outer diameter: 660 mmϕ).

Specimens are sampled from the obtained hot-rolled steel sheets, and the observation of structure, a tensile test, an impact test, a DWTT test and a CTOD test are carried out with respect to these specimens. The DWTT test and the CTOD test are also carried out with respect to the electric resistance welded steel pipe. The following test methods are used.

(1) Observation of Structure

A structure-observation-use specimen is sampled from the obtained hot-rolled steel sheet, a cross-section of the specimen in the rolling direction is polished and etched. The cross section is observed and is imaged, and the structure is identified for each specimen with three visual fields or more using an optical microscope (magnification: 1000 times) or a scanning electron microscope (magnification: 2000 times). Further, using an image analyzer, an average grain size of a ferrite phase and a structural fraction (volume %) of a secondary phase other than the ferrite phase are measured. Observation positions are set to a position 1 mm away from a surface of the steel sheet in the sheet thickness direction and a sheet thickness center position. The average grain size of the ferrite phase is obtained such that an average grain size is obtained by a cutting method, and a nominal grain size is set as the average grain size at the position.

(2) Tensile Strength Test

A plate-shaped specimen (width of flat portion: 25 mm, gauge length: 50 mm) is sampled from the obtained hot-rolled steel sheet such that the tensile strength test direction is taken along the direction orthogonal to the rolling direction (C direction), and a tensile strength test is carried out with respect to the specimen in accordance with provisions of ASTM E8M-04 at a room temperature thus obtaining tensile strength TS.

(3) Impact Test

V notch specimens are sampled from a sheet thickness center portion of the obtained hot-rolled steel sheet such that the longitudinal direction is taken in the direction orthogonal to the rolling direction (C direction), and a Charpy impact test is carried out in accordance with provisions of JIS Z 2242 thus obtaining absorbed energy (J) at a test temperature of −80° C. The number of specimens is three and an arithmetic average of the obtained absorbed energy values is obtained, and the arithmetic average is set as an absorbed energy value $vE_{-80}$(J) of the steel sheet. The evaluation "favorable toughness" is given when $vE_{-80}$ is 200 J or more.

(4) DWTT Test

DWTT specimens (size: sheet thickness×width of 3 in.× length of 12 in.) are sampled from the obtained hot-rolled steel sheet such that the longitudinal direction is taken in the direction orthogonal to the rolling direction (C direction), and a DWTT test is carried out in accordance with provisions of ASTM E 436 thus obtaining the lowest temperature at which percent ductile fracture becomes 85%. The evaluation "excellent DWTT characteristics" is given when the DWTT is −30° C. or below.

In the DWTT test, DWTT specimens are also sampled from a parent material portion of an electric resistance welded steel pipe such that the longitudinal direction of the specimen is taken the pipe circumferential direction, and the test is carried out in the same manner as the steel sheet.

(5) CTOD Test

CTOD specimens (size: sheet thickness×width (2×sheet thickness)×length (10×sheet thickness)) are sampled from the obtained hot-rolled steel sheet such that the longitudinal direction is taken in the direction orthogonal to the rolling direction (C direction), and the CTOD test is carried out in accordance with provisions of ASTM E 1290 at the test temperature of −10° C. thus obtaining a crack tip opening displacement amount (CTOD value) at a temperature of −10° C. A test force is loaded based on a three point bending method, a displacement gauge is mounted on a notched portion, and crack tip opening displacement amount CTOD value is obtained. The evaluation "excellent CTOD characteristics" is given when the CTOD value is 0.30 mm or more.

In the CTOD test, CTOD specimens are also sampled from an electric resistance welded steel pipe such that the longitudinal direction of the specimen is taken in the direction orthogonal to the pipe axial direction, a notch is formed in a parent material portion and a seam portion, and the CTOD test is carried out in the same manner as the steel sheet.

Obtained results are shown in Table 6.

All examples of the present invention provide hot-rolled steel sheets which possess the proper structure, high strength with TS of 530 MPa or more and the excellent low-temperature toughness in which $vE_{-80}$ is 200 J or more, the CTOD value is 0.30 mm or more and DWTT is −30° C. or below, and particularly possess the excellent CTOD characteristics and the excellent DWTT characteristics. The electric resistance welded steel pipe manufactured using the hot-rolled steel sheet of the example of the present invention also forms the steel pipe having the excellent low-temperature toughness in which the both parent material portion and the seam portion have a CTOD value of 0.30 mm or more and DWTT of −5° C. or below.

On the other hand, in comparison examples, $vE_{-80}$ is less than 200 J, the CTOD value is less than 0.30 mm or DWTT exceeds −20° C. and hence, the low-temperature toughness is deteriorated.

TABLE 4

| steel No. | chemical component (mass %) C | Si | Mn | P | S | Al | Nb | Ti | N | O | V, Mo, Cr, Cu, Ni | Ca | left-side value in formula(1)* | remarks |
|---|---|---|---|---|---|---|---|---|---|---|---|---|---|---|
| A | 0.038 | 0.19 | 0.95 | 0.016 | 0.0021 | 0.03 | 0.042 | 0.008 | 0.0021 | 0.003 | Mo: 0.14 | — | 0.8 | example of present invention |
| B | 0.043 | 0.2 | 1.39 | 0.014 | 0.0019 | 0.037 | 0.051 | 0.008 | 0.0025 | 0.0032 | — | 0.0023 | 0.8 | example of present invention |
| C | 0.059 | 0.22 | 1.62 | 0.018 | 0.0024 | 0.039 | 0.061 | 0.016 | 0.0027 | 0.0031 | — | — | 0.8 | example of present invention |
| D | 0.039 | 0.24 | 1.35 | 0.019 | 0.0023 | 0.042 | 0.059 | 0.015 | 0.0022 | 0.0033 | Mo: 0.15, Cu: 0.15, NI: 0.15 | 0.0021 | 1.1 | example of present invention |
| E | 0.042 | 0.25 | 1.55 | 0.013 | 0.0029 | 0.034 | 0.058 | 0.012 | 0.0035 | 0.0038 | V: 0.049, Cu: 0.22, Ni: 0.21 | — | 1.0 | example of present invention |
| F | 0.051 | 0.23 | 1.6 | 0.014 | 0.0023 | 0.033 | 0.062 | 0.015 | 0.0033 | 0.003 | Cr: 0.31 | — | 0.9 | example of present invention |
| G | 0.042 | 0.25 | 1.65 | 0.015 | 0.0015 | 0.035 | 0.062 | 0.016 | 0.0029 | 0.0036 | V: 0.059, Cu: 0.29, Ni: 0.28, Mo: 0.15 | 0.0020 | 1.1 | example of present invention |
| H | 0.058 | 0.26 | 1.85 | 0.019 | 0.0025 | 0.036 | 0.073 | 0.018 | 0.0027 | 0.0033 | Cr: 0.19, Cu: 0.11, Ni: 0.21, Mo: 0.24 | 0.0018 | 0.9 | example of present invention |
| I | 0.017 | 0.69 | 1.27 | 0.012 | 0.0023 | 0.049 | 0.140 | 0.032 | 0.0028 | 0.0037 | — | — | 6.0 | comparison example |

*left-side value in formula(1) = (Ti + Nb/2)/C

TABLE 5

| steel sheet No. | steel No. | hot rolling: heating temperature (° C.) | finish rolling start temperature (° C.) | finish rolling finish temperature (° C.) | effective reduction ratio (%) | cooling after hot rolling: cooling start temperature T** (° C.) | holding time from T to (T −20° C.)** (s) | cooling rate* (° C./s) |
|---|---|---|---|---|---|---|---|---|
| 1 | A | 1190 | 1010 | 810 | 63 | 808 | 7 | 21 |
| 2 | A | 1210 | 1020 | 800 | 60 | 798 | 12 | 26 |
| 3 | A | 1200 | 1030 | 805 | 51 | 803 | 25 | 5 |
| 4 | B | 1210 | 1030 | 810 | 54 | 808 | 7 | 38 |
| 5 | B | 1230 | 1020 | 810 | 57 | 808 | 8 | 26 |
| 6 | B | 1210 | 1010 | 810 | 55 | 808 | 19 | 12 |
| 7 | C | 1200 | 1020 | 800 | 53 | 798 | 12 | 32 |
| 8 | D | 1200 | 1030 | 805 | 52 | 803 | 15 | 33 |
| 9 | E | 1210 | 1010 | 800 | 59 | 798 | 18 | 28 |
| 10 | F | 1190 | 1020 | 810 | 52 | 808 | 9 | 30 |
| 11 | F | 1190 | 1020 | 815 | 50 | 807 | 12 | 10 |
| 12 | G | 1210 | 1010 | 800 | 44 | 798 | 17 | 22 |
| 13 | G | 1200 | 1000 | 800 | 43 | 798 | 31 | 40 |

TABLE 5-continued

| | | | | | | | | |
|---|---|---|---|---|---|---|---|---|
| 14 | H | 1200 | 930 | 795 | 45 | 793 | 16 | 30 |
| 15 | H | 1200 | 930 | 795 | 47 | 793 | 16 | 20 |
| 16 | I | 1200 | 1100 | 860 | 56 | 858 | 15 | 20 |

| | cooling after hot rolling | | coiling | | | | |
|---|---|---|---|---|---|---|---|
| steel sheet No. | cooling stop temperature** (° C.) | cooling time between T to BFS** (s) | coiling temperature (° C.) | BFS (° C.) | BFS0 (° C.) | sheet thickness (mm) | remarks |
| 1 | 520 | 15 | 510 | 637 | 668 | 22.2 | example of present invention |
| 2 | 550 | 19 | 540 | 629 | 668 | 25.4 | example of present invention |
| 3 | 620 | 54 | 600 | 661 | 668 | 25.4 | comparison example |
| 4 | 550 | 12 | 500 | 603 | 660 | 22.2 | example of present invention |
| 5 | 430 | 15 | 410 | 621 | 660 | 25.4 | example of present invention |
| 6 | 560 | 33 | 550 | 642 | 660 | 22.2 | comparison example |
| 7 | 490 | 18 | 480 | 591 | 639 | 23.8 | example of present invention |
| 8 | 500 | 22 | 470 | 577 | 626 | 25.4 | example of present invention |
| 9 | 480 | 25 | 460 | 590 | 632 | 23.8 | example of present invention |
| 10 | 470 | 17 | 465 | 576 | 621 | 22.2 | example of present invention |
| 11 | 605 | 32 | 690 | 606 | 621 | 25.4 | comparison example |
| 12 | 500 | 28 | 480 | 561 | 594 | 28.5 | example of present invention |
| 13 | 470 | 38 | 470 | 534 | 594 | 22.2 | comparison example |
| 14 | 420 | 25 | 410 | 511 | 556 | 27.0 | example of present invention |
| 15 | 530 | 29 | 560 | 526 | 556 | 27.0 | comparison example |
| 16 | 510 | 23 | 500 | 631 | 676 | 25.4 | comparison example |

*average cooling rate in temperature range from 750 to 650° C. at sheet thickness center portion

**T indicates temperature at sheet thickness center position at accelerated cooling start time

TABLE 6

| | | structure at sheet thickness center position | | | steel sheet structural difference in the sheet thickness direction* | | | |
|---|---|---|---|---|---|---|---|---|
| steel sheet No. | steel No. | kind** | average grain size of ferrite D (μm) | structural fraction V of second phase (vol. %) | difference ΔD in average grain size of ferrite (μm) | structural fraction difference ΔV of second phase (vol. %) | tensile characteristics TS (MPa) | low-temperature toughness $vE_{-80}$ (J) |
| 1 | A | BF + M | 4.2 | 0.2 | 0.5 | 0.1 | 567 | 357 |
| 2 | A | BF + M | 3.6 | 0.3 | 0.4 | 0.2 | 578 | 356 |
| 3 | A | BF + F + | 6.2 | 2.2 | 1.8 | 1.9 | 569 | 173 |
| 4 | B | BF + M | 3.8 | 0.2 | 0.3 | 0.1 | 573 | 372 |
| 5 | B | B + M | 3.6 | 0.1 | 0.2 | 0.1 | 574 | 360 |
| 6 | B | BF + F + | 4.8 | 2.5 | 1.7 | 2 | 584 | 189 |
| 7 | C | B + M | 3.2 | 0.2 | 0.9 | 0.2 | 638 | 287 |
| 8 | D | B + M | 3.4 | 0.3 | 0.3 | 0.2 | 676 | 259 |
| 9 | E | B + M | 3.3 | 0.2 | 0.3 | 0.1 | 698 | 257 |
| 10 | F | B + M | 3.3 | 0.3 | 0.1 | 0.2 | 684 | 256 |
| 11 | F | B + F + M | 5.5 | 1.7 | 1.5 | 1.6 | 672 | 143 |
| 12 | G | B + M | 3.6 | 0.5 | 0.3 | 0.5 | 714 | 239 |
| 13 | G | B + F + M | 4.9 | 2.5 | 1.7 | 2.6 | 709 | 98 |
| 14 | H | B + M | 2.8 | 0.6 | 0.2 | 0.6 | 726 | 222 |
| 15 | H | B + F + M | 3.9 | 2.5 | 2.3 | 2.5 | 739 | 72 |
| 16 | I | F | 6.5 | 0.1 | 1.4 | 1.4 | 683 | 321 |

TABLE 6-continued

| | low-temperature toughness | | low-temperature toughness of steel pipe | | | |
|---|---|---|---|---|---|---|
| | | | parent material portion | | seam portion | |
| steel sheet No. | DWTT (° C.) | CTOD value (at −10° C.) (mm) | DWTT (° C.) | CTOD value (at −10° C.) (mm) | CTOD value (at −10° C.) (mm) | remarks |
| 1 | −50 | 0.98 | −30 | 0.87 | 0.89 | example of present invention |
| 2 | −55 | 0.89 | −30 | 0.79 | 0.78 | example of present invention |
| 3 | −30 | 0.68 | −5 | 0.66 | 0.51 | comparison example |
| 4 | −65 | 0.77 | −40 | 0.79 | 0.75 | example of present invention |
| 5 | −70 | 0.82 | −45 | 0.98 | 0.88 | example of present invention |
| 6 | −30 | 0.36 | −5 | 0.32 | 0.68 | comparison example |
| 7 | −70 | 0.83 | −45 | 0.68 | 0.69 | example of present invention |
| 8 | −60 | 0.75 | −35 | 0.80 | 0.74 | example of present invention |
| 9 | −65 | 0.72 | −40 | 0.74 | 0.72 | example of present invention |
| 10 | −65 | 0.88 | −40 | 0.73 | 0.78 | example of present invention |
| 11 | −30 | 0.73 | −5 | 0.42 | 0.39 | comparison example |
| 12 | −45 | 0.61 | −20 | 0.72 | 0.65 | example of present invention |
| 13 | −20 | 0.59 | 5 | 0.47 | 0.38 | comparison example |
| 14 | −60 | 0.70 | −35 | 0.64 | 0.53 | example of present invention |
| 15 | −10 | 0.57 | 15 | 0.39 | 0.32 | comparison example |
| 16 | −50 | 0.72 | −25 | 0.69 | 0.07 | comparison example |

*structural difference between position 1 mm away from surface in the sheet thickness direction and sheet thickness center position,
**F: ferrite, B: bainite, BF: bainitic ferrite, M: martensite, P: perlite

Mode of Third Embodiment of the Present Invention

The high-tensile-strength hot-rolled steel sheet having TS of 560 MPa or more has the structure in which the primary phase of the structure at the position 1 mm away from the surface in the sheet thickness direction is formed of either tempered martensite or the mixture structure consisting of bainite and tempered martensite, in which the structure at the sheet thickness center position includes the primary phase formed of bainite and/or bainitic ferrite and the secondary phase which is 2% or less by volume %, and in which the difference ΔHV between Vickers hardness HV1mm at the position 1 mm away from the surface in the sheet thickness direction and Vickers hardness HV1/2t at the sheet thickness center position is 50 points or less.

When the primary phase of the structure at the position 1 mm away from the surface in the sheet thickness direction is formed of either tempered martensite or the mixture structure consisting of bainite and tempered martensite, the structure at the sheet thickness center position includes the primary phase formed of bainite and/or bainitic ferrite and the secondary phase which is 2% or less by volume %, and the difference ΔHV between Vickers hardness HV1mm at the position 1 mm away from the surface in the sheet thickness direction and Vickers hardness HV1/2t at the sheet thickness center position is 50 points or less, the low-temperature toughness, particularly DWTT characteristics and CTOD characteristics when a total thickness specimen is used are remarkably enhanced. When the structure at the position 1 mm away from the surface in the sheet thickness direction is the structure other than the above-mentioned structure, or when the structure at the sheet thickness center position is the structure where the secondary phase exceeds 2% by volume %, or when the difference ΔHV between Vickers hardness HV1mm at the position 1 mm away from the surface in the sheet thickness direction and Vickers hardness HV1/2t at the sheet thickness center position exceeds 50 points, the DWTT characteristics is deteriorated so that the low-temperature toughness is deteriorated.

Accordingly, the structure of the high-tensile-strength hot-rolled steel sheet is optionally limited to the structure where the primary phase of the structure is formed of either tempered martensite or a mixture structure consisting of bainite and tempered martensite, the structure at the sheet thickness center position includes the primary phase formed of bainite and/or bainitic ferrite and the secondary phase which is 2% or less by volume %, and the difference ΔHV between Vickers hardness HV1mm at the position 1 mm away from the surface in the sheet thickness direction and Vickers hardness HV1/2t at the sheet thickness center position is 50 points or less.

In the case of the hot-rolled steel sheet having TS of 560 MPa or more, after the finish rolling is completed, a cooling step which is constituted of first-stage cooling and second-stage cooling is applied to the hot-rolled steel sheet at least twice, and third-stage cooling is applied to the hot-rolled steel sheet in order.

In the first-stage cooling, the hot-rolled steel sheet is cooled to a temperature range of an Ms point or below (cooling stop temperature) in terms of a temperature at a position 1 mm away from a surface of the hot-rolled steel sheet in the sheet thickness direction at a cooling rate exceeding 80° C./s in terms of an average cooling rate at the position 1 mm away from the surface of the hot-rolled steel sheet. Due to such first-stage cooling, a primary phase of the structure of a region extending from the surface in the sheet thickness direction approximately by 2 mm becomes a martensite phase or the mixture structure formed of a martensite phase and a bainite phase. When the cooling rate is 80° C./s or below, a martensite phase is not sufficiently formed so that a tempering effect cannot be expected in a coiling step which follows the cooling step. It is preferable to set the bainite phase to 50% or less by volume %. Whether the primary phase is formed of martensite or the mixture structure of bainite and martensite depends on a carbon equivalent of the steel sheet or a cooling rate in the first stage. Further, although an upper limit of the cooling rate is decided depending on ability of a cooling device in use, the upper limit is approximately 600° C./s.

As temperatures such as the temperature at the position 1 mm away from the surface in the sheet thickness direction, the temperature at the sheet thickness center position and the like, the cooling rate and the like, values which are calculated by the heat transfer calculation or the like are used.

After the first-stage cooling, as second-stage cooling, air cooling is performed for 30 s or less. Due to the second-stage cooling, a surface layer is recuperated due to potential heat of the center portion so that the surface layer structure formed in the first-stage cooling is tempered whereby the surface layer structure becomes either tempered martensite or the mixture structure formed of bainite and tempered martensite both of which possess sufficient toughness. Air cooling is performed in the second-stage cooling for preventing the formation of a martensite phase in the inside of hot-rolled steel sheet in the sheet thickness direction. When the air cooling time exceeds 30 seconds, the transformation to polygonal ferrite at the sheet thickness center position progresses. Accordingly, the air cooling time in the second-stage cooling is limited to 30 s or less. The air cooling time is preferably 0.5 s or more and 20 s or less.

The cooling step constituted of the first-stage cooling and the second-stage cooling is performed at least twice.

After performing the cooling step constituted of the first-stage cooling and the second-stage cooling at least twice, third cooling is further performed. In the third cooling, the hot-rolled steel sheet is cooled to a cooling stop temperature which is BFS defined by the following formula (2) or below in terms of a temperature at a sheet thickness center position at a cooling rate exceeding 80° C./s in terms of an average cooling rate at the position 1 mm away from the surface of the hot-rolled steel sheet in the sheet thickness direction.

$$BFS(^\circ C.)=770-300C-70Mn-70Cr-170Mo-40Cu-40Ni-1.5CR \quad (2)$$

(Here, C, Mn, Cr, Mo, Cu, Ni: contents of respective elements (mass %), CR: cooling rate (° C./s))

In the calculation expressed by the formula (2), the calculation is made by setting the content of an alloy element when the alloy element is not contained in the hot-rolled steel sheet to zero.

When the average cooling rate at the position 1 mm away from the surface in the sheet thickness direction is 80° C./s or less, cooling of the sheet thickness center portion is delayed so that polygonal ferrite is formed at the sheet thickness center position whereby the structure where the primary phase is formed of any one of desired bainitic ferrite phase, bainite phase and the mixture structure of the bainitic ferrite phase and the bainite phase cannot be secured. Further, when the cooling stop temperature becomes high exceeding BFS, a secondary phase formed of any one of martensite, upper bainite, perlite, MA and the mixture structure constituted of two or more kinds of phases is formed so that the desired structure cannot be secured. In view of the above, in the third-stage cooling, the average cooling rate at the position 1 mm away from the surface in the sheet thickness direction is set to a cooling rate which exceeds 80° C./s, and the cooling stop temperature at the sheet thickness center position is set to a temperature of BFS or below. In such third-stage cooling, the average cooling rate at the sheet thickness center position becomes 20° C./s or more so that the formation of the secondary phase is suppressed whereby the structure at the sheet thickness center position can be turned into the desired structure.

After the third-stage cooling, the hot-rolled steel sheet is coiled at a coiling temperature of BFS0 defined by the following formula (3) or less, preferably a temperature of an Ms point or above as the temperature at the sheet thickness center position.

$$BFS0(^\circ C.)=770-300C-70Mn-70Cr-170Mo-40Cu-40Ni \quad (3)$$

(Here, C, Mn, Cr, Mo, Cu, Ni: contents of respective elements (mass %))

Accordingly, the martensite phase formed in the first-stage cooling can be tempered thus forming tempered martensite which possesses sufficient toughness. The coiling temperature is preferably (BFS0−20° C.) or below. To allow the hot-rolled steel sheet to sufficiently posses s such a tempering effect, it is preferable to hold the hot-rolled steel sheet in a temperature range from (coiling temperature) to (coiling temperature−50° C.) for 30 min or more. In the calculation expressed by the formula (3), the calculation is made by setting the content of an alloy element when the alloy element is not contained in the hot-rolled steel sheet to zero.

By applying the above-mentioned cooling step constituted of the first-stage cooling and the second-stage cooling, the third-stage cooling and the coiling step to the hot-rolled steel sheet, it is possible to manufacture the hot-rolled steel sheet which possesses excellent uniformity in the structure in the sheet thickness direction and possesses the excellent low-temperature toughness with DWTT of −50° C. or below, wherein the structure at the position 1 mm away from the surface in the sheet thickness direction is either the tempered martensite single-phase structure or the mixture structure of bainite and tempered martensite, the structure at the sheet thickness center position includes the primary phase formed of bainite and/or bainitic ferrite and the secondary phase which is 2% or less by volume %, and the difference ΔHV between Vickers hardness HV1mm at the position 1 mm away from the surface in the sheet thickness direction and Vickers hardness HV1/2t at the sheet thickness center position is 50 points or less.

When the difference ΔHV between Vickers hardness HV1mm at the position 1 mm away from the surface in the sheet thickness direction and Vickers hardness HV1/2t at the sheet thickness center position exceeds 50 points, the uniformity in the sheet thickness direction is lowered thus deteriorating the low-temperature toughness.

Example 3

The example relating to the hot-rolled steel sheet having TS of 560 MPa or more is explained hereinafter.

Slabs (raw steel materials) having the compositions shown in Table 7 (thickness: 215 mm) are subjected to hot rolling under hot rolling conditions shown in Table 8, Table 9-1 and Table 9-2. After hot rolling is completed, the hot-rolled sheets are cooled under cooling conditions shown in Table 8, Table 9-1 and Table 9-2, and are coiled in a coil shape at coiling temperatures shown in Table 8, Table 9-1 and Table 9-2, and are turned into hot-rolled steel sheets (steel strips) having sheet thicknesses shown in Table 8, Table 9-1 and Table 9-2. Using these hot-rolled steel sheets as raw materials, open pipes are formed by roll continuous forming by cold forming, and end surfaces of the open pipes are welded together by electric resistance welding thus manufacturing an electric resistance welded steel pipe (outer diameter: 660 mmϕ).

Specimens are sampled from the obtained hot-rolled steel sheets, and the observation of structure, a hardness test, a tensile-strength test, an impact test, a DWTT test and a CTOD test are carried out with respect to these specimens. The DWTT test and the CTOD test are also carried out with respect to the electric resistance welded steel pipe. The following test methods are used.

(1) Observation of Structure

A structure-observation-use specimen is sampled from the obtained hot-rolled steel sheet, a cross-section of the specimen in the rolling direction is polished and etched. The cross section is observed, and is imaged, a kind of the structure is identified for each specimen with two visual fields or more using an optical microscope (magnification: 1000 times) or a scanning electron microscope (magnification: 2000 times). Further, using an image analyzer, an average grain size of respective phases and a structural fraction (volume %) of a secondary phase other than the primary phase are measured. Observation positions are set to a position 1 mm away from a surface of the steel sheet in the sheet thickness direction and a sheet thickness center portion.

(2) Hardness Test

Structure-observation-use specimens are sampled from the obtained hot-rolled steel sheets and hardness HV is measured with respect to a cross section in the rolling direction using a Vickers hardness tester (testing force: 9.8N (load: 1 kgf)). Measurement positions are set at a position 1 mm away from a surface in the sheet thickness direction and a sheet thickness center portion. The hardness is measured at 5 points or more in each position. Arithmetic average values are obtained by calculating the obtained result and these arithmetic values are set as hardness at respective positions. Based on the obtained hardness at the respective positions, the difference ΔHV (=HV1mm−HV1/2t) between hardness HV1mm at the position 1 mm away from the surface in the sheet thickness direction and hardness HV1/2t at the sheet thickness center position is calculated.

(3) Tensile Strength Test

A plate-shaped specimen (width of flat portion: 25 mm, gauge length: 50 mm) is sampled from the obtained hot-rolled steel sheet such that the longitudinal direction is taken along the direction orthogonal to the rolling direction (C direction), and a tensile strength test is carried out with respect to the specimen in accordance with provisions of ASTM E8M-04 at a room temperature thus obtaining tensile strength TS.

(4) Impact Test

V notch specimens are sampled from a sheet thickness center portion of the obtained hot-rolled steel sheet such that the longitudinal direction is taken in the direction orthogonal to the rolling direction (C direction), and a Charpy impact test is carried out in accordance with provisions of JIS Z 2242 thus obtaining absorbed energy (J) at a test temperature of −80° C. The number of specimens is three and an arithmetic average of the obtained absorbed energy values is obtained, and the arithmetic average is set as an absorbed energy value vE_80 (J) of the steel sheet. The evaluation "favorable toughness" is given when $vE_{-80}$ is 200 J or more.

(5) DWTT Test

DWTT specimens (size: sheet thickness×width of 3 in.× length of 12 in.) are sampled from the obtained hot-rolled steel sheet such that the longitudinal direction is taken in the direction orthogonal to the rolling direction (C direction), and a DWTT test is carried out in accordance with provisions of ASTM E 436 thus obtaining the lowest temperature (DWTT) at which percent ductile fracture becomes 85%. The evaluation "excellent DWTT characteristics" is given when the DWTT is −50° C. or below.

In the DWTT test, DWTT specimens are also sampled from a parent material portion of an electric resistance welded steel pipe such that the longitudinal direction of the specimen becomes the pipe circumferential direction, and the test is carried out in the same manner as the steel sheet.

(6) CTOD Test

CTOD specimens (size: sheet thickness×width (2×sheet thickness)×length (10×sheet thickness)) are sampled from the obtained hot-rolled steel sheet such that the longitudinal direction is taken in the direction orthogonal to the rolling direction (C direction), and the CTOD test is carried out in accordance with provisions of ASTM E 1290 at the test temperature of −10° C. thus obtaining a crack tip opening displacement amount (CTOD value) at a temperature of −10° C. A test force is loaded based on a three point bending method, a displacement gauge is mounted on a notched portion, and a crack tip opening displacement amount (CTOD value) is obtained. The evaluation "excellent CTOD characteristics" is given when the CTOD value is 0.30 mm or more.

In the CTOD test, CTOD specimens are also sampled from an electric resistance welded steel pipe such that the longitudinal direction of the specimen is taken in the direction orthogonal to the pipe axial direction, a notch is formed in a parent material portion and a seam portion, and the CTOD test is carried out in the same manner as the steel sheet.

Obtained results are shown in Table 10.

All examples of the present invention provide hot-rolled steel sheets which have the proper structure, proper hardness, high strength with TS of 560 MPa or more and the excellent low-temperature toughness in which $vE_{-80}$ is 200 J or more, the CTOD value is 0.30 mm or more and DWTT is −50° C. or below so that the hot-rolled steel sheets particularly have the excellent CTOD characteristics and the excellent DWTT characteristics. Further, the electric resistance welded steel pipe manufactured using the hot-rolled steel sheet of the example of the present invention also forms the steel pipe having the excellent low-temperature toughness in which the both the parent material portion and the seam portion have a CTOD value of 0.30 mm or more and DWTT of −25° C. or below.

On the other hand, in comparison examples, $vE_{-80}$ is less than 200 J, the CTOD value is less than 0.30 mm, DWTT exceeds the −50° C. or ΔHV exceeds 50 points and hence, the low-temperature toughness is deteriorated. The low-temperature toughness of seam portions of electric resistance welded steel pipes manufactured using these steel sheets are also deteriorated.

TABLE 7

| | chemical component (mass %) | | | | | | | | | | | | left-side | |
|---|---|---|---|---|---|---|---|---|---|---|---|---|---|---|
| steel No. | C | Si | Mn | P | S | Al | Nb | Ti | N | O | V, Mo, Cr, Cu, Ni | Ca | value in formula(1)* | remarks |
| A | 0.042 | 0.21 | 1.45 | 0.015 | 0.0023 | 0.038 | 0.049 | 0.009 | 0.0032 | 0.0025 | Mo: 0.18 | — | 0.8 | example of present invention |
| B | 0.041 | 0.22 | 1.60 | 0.015 | 0.0021 | 0.041 | 0.060 | 0.012 | 0.0033 | 0.0028 | — | — | 1.0 | example of present invention |

TABLE 7-continued

| steel No. | chemical component (mass %) C | Si | Mn | P | S | Al | Nb | Ti | N | O | V, Mo, Cr, Cu, Ni | Ca | left-side value in formula(1)* | remarks |
|---|---|---|---|---|---|---|---|---|---|---|---|---|---|---|
| C | 0.075 | 0.24 | 1.63 | 0.015 | 0.0027 | 0.038 | 0.059 | 0.011 | 0.0032 | 0.0032 | V: 0.049 | — | 0.5 | example of present invention |
| D | 0.051 | 0.20 | 1.60 | 0.016 | 0.0023 | 0.036 | 0.061 | 0.012 | 0.0038 | 0.0027 | Cr: 0.30 | 0.0022 | 0.8 | example of present invention |
| E | 0.035 | 0.21 | 1.64 | 0.015 | 0.0024 | 0.038 | 0.059 | 0.011 | 0.0039 | 0.0022 | V: 0.060, Cu: 0.30, Ni: 0.30, Mo: 0.14 | 0.0021 | 1.2 | example of present invention |
| F | 0.040 | 0.23 | 1.70 | 0.015 | 0.0028 | 0.030 | 0.015 | 0.014 | 0.0032 | 0.0032 | Mo: 0.15 | — | 0.5 | example of present invention |
| G | 0.040 | 0.39 | 1.61 | 0.015 | 0.0020 | 0.036 | 0.070 | 0.011 | 0.0041 | 0.0032 | Mo: 0.25, V: 0.049, Ni: 0.25, Cu: 0.25 | 0.0020 | 1.2 | example of present invention |
| H | 0.039 | 0.19 | 1.65 | 0.018 | 0.0016 | 0.036 | 0.051 | 0.014 | 0.0029 | 0.0024 | V: 0.072, Cr: 0.15, Cu: 0.24, Ni: 0.21, Mo: 0.23 | 0.0018 | 1.0 | example of present invention |
| I | 0.016 | 0.70 | 1.25 | 0.003 | 0.0022 | 0.048 | 0.150 | 0.030 | 0.0033 | 0.0029 | — | — | 6.6 | comparison example |

*left-side value in formula(1) = (Ti + Nb/2)/C

TABLE 8

| steel sheet No. | steel No. | hot rolling heating temperature (° C.) | finish rolling entrance-side temperature FET* (° C.) | finish rolling exit-side temperature FDT* (° C.) | effective reduction ratio (%) |
|---|---|---|---|---|---|
| 1 | A | 1200 | 970 | 790 | 64 |
| 2 | A | 1200 | 980 | 780 | 59 |
| 3 | A | 1200 | 980 | 785 | 52 |
| 4 | B | 1220 | 970 | 790 | 53 |
| 5 | B | 1220 | 970 | 790 | 58 |
| 6 | B | 1220 | 970 | 790 | 56 |
| 7 | C | 1200 | 980 | 780 | 54 |
| 8 | D | 1200 | 980 | 785 | 54 |
| 9 | E | 1200 | 960 | 780 | 58 |
| 10 | F | 1200 | 960 | 790 | 53 |
| 11 | F | 1200 | 960 | 795 | 52 |

TABLE 8-continued

| steel sheet No. | steel No. | hot rolling heating temperature (° C.) | finish rolling entrance-side temperature FET* (° C.) | finish rolling exit-side temperature FDT* (° C.) | effective reduction ratio (%) |
|---|---|---|---|---|---|
| 12 | G | 1200 | 960 | 780 | 45 |
| 13 | G | 1200 | 960 | 780 | 45 |
| 14 | H | 1220 | 880 | 775 | 46 |
| 15 | H | 1220 | 880 | 775 | 46 |
| 16 | I | 1230 | 1050 | 840 | 55 |
| 17 | A | 1200 | 970 | 790 | 64 |

*temperature at position 1 mm away from surface

**temperature at sheet thickness center portion

***temperature range from coiling temperature to (coiling temperature −50° C.)

TABLE 9-1

| steel sheet No. | steel No. | cooling after hot rolling: cooling start temperature* (° C.) | first-stage cooling: cooling rate at position 1 mm away from surface (C./s) | first-stage cooling: cooling stop temperature* (° C.) | air cooling time of second-stage cooling (%) | first-stage cooling (repeated): cooling rate at position 1 mm away from surface (° C./s) | first-stage cooling (repeated): cooling stop temperature* (° C.) | air cooling: time of second-stage cooling (repeated) (s) | third-stage cooling: cooling rate at position 1 mm away from surface (° C./s) | third-stage cooling: cooling stop temperature* (° C.) |
|---|---|---|---|---|---|---|---|---|---|---|
| 1 | A | 808 | 448 | 400 | 1.5 | 200 | 380 | 1.5 | 210 | 190 |
| 2 | A | 798 | 223 | 380 | 1 | 200 | 350 | 1.5 | 220 | 190 |
| 3 | A | 803 | 298 | 400 | 35 | 200 | 350 | 1 | 220 | 190 |
| 4 | B | 808 | 195 | 400 | 1 | 190 | 340 | 1 | 250 | 180 |
| 5 | B | 808 | 223 | 400 | 1.2 | 190 | 320 | 1.2 | 250 | 180 |
| 6 | B | 808 | 341 | 400 | 1.2 | 190 | 320 | 1.2 | 250 | 200 |
| 7 | C | 798 | 176 | 380 | 2 | 220 | 240 | 1.5 | 180 | 200 |
| 8 | D | 803 | 192 | 370 | 2 | 210 | 230 | 1.5 | 200 | 190 |
| 9 | E | 798 | 357 | 420 | 2 | 200 | 240 | 1.5 | 210 | 190 |

TABLE 9-1-continued

| steel sheet No. | cooling after hot rolling cooling at sheet thickness center position: cooling rate (° C./s) | cooling stop temperature (° C.) | coiling: coiling temperature** (° C.) | holding time*** (min) | BFS (° C.) | BFS0 (° C.) | Ms (° C.) | sheet thickness (mm) | remarks |
|---|---|---|---|---|---|---|---|---|---|
| 1 | 65 | 470 | 455 | 80 | 528 | 625 | 486 | 17.5 | example of present invention |
| 2 | 38 | 500 | 495 | 80 | 568 | 625 | 486 | 22.2 | example of present invention |
| 3 | 45 | 500 | 495 | 95 | 558 | 625 | 486 | 22.2 | comparison example |
| 4 | 45 | 560 | 540 | 95 | 579 | 646 | 486 | 14.5 | example of present invention |
| 5 | 35 | 500 | 480 | 95 | 594 | 646 | 486 | 25.4 | example of present invention |
| 6 | 45 | 500 | 480 | 20 | 579 | 646 | 486 | 25.4 | comparison example |
| 7 | 35 | 520 | 500 | 90 | 581 | 633 | 469 | 20.1 | example of present invention |
| 8 | 32 | 540 | 570 | 85 | 574 | 622 | 476 | 25.4 | example of present invention |
| 9 | 50 | 550 | 580 | 85 | 512 | 587 | 479 | 22.2 | example of present invention |

*temperature at position 1 mm away from surface,
*temperature at sheet thickness center portion,
***temperature range from coiling temperature to (coiling temperature −50° C.)

TABLE 9-2

| steel sheet No. | steel No. | cooling after hot rolling: cooling start temperature* (° C.) | first-stage cooling: cooling rate at position 1 mm away from surface (C./s) | first-stage cooling: cooling stop temperature* (° C.) | air cooling time of second-stage cooling (%) | first-stage cooling (repeated): cooling rate at position 1 mm away from surface (° C./s) | first-stage cooling (repeated): cooling stop temperature* (° C.) | air cooling: time of second-stage cooling (repeated) (s) | third-stage cooling: cooling rate at position 1 mm away from surface (° C./s) | third-stage cooling: cooling stop temperature* (° C.) |
|---|---|---|---|---|---|---|---|---|---|---|
| 10 | F | 808 | 388 | 400 | 1.5 | 190 | 230 | 1 | 230 | 180 |
| 11 | F | 807 | 388 | 400 | 2 | 190 | 230 | 1.5 | 230 | 180 |
| 12 | G | 798 | 259 | 400 | 1.5 | 180 | 350 | 1.5 | 180 | 180 |
| 13 | G | 798 | 259 | 380 | 2 | 180 | 320 | 1 | 180 | 180 |
| 14 | H | 793 | 223 | 390 | 5 | 200 | 320 | 1.5 | 200 | 190 |
| 15 | H | 793 | 70 | 380 | 2 | 200 | 320 | 1.5 | 200 | 190 |
| 16 | I | 858 | 235 | 390 | 2 | 200 | 350 | 1 | 220 | 190 |
| 17 | A | 805 | 223 | 470 | 2 (3 times) | 150 220 | 400 260 | 1.5 1 | 180 | 200 |

| steel sheet No. | cooling after hot rolling cooling at sheet thickness center position: cooling rate (° C./s) | cooling stop temperature (° C.) | coiling: coiling temperature** (° C.) | holding time*** (min) | BFS (° C.) | BFS0 (° C.) | Ms (° C.) | sheet thickness (mm) | remarks |
|---|---|---|---|---|---|---|---|---|---|
| 10 | 60 | 470 | 465 | 70 | 524 | 614 | 480 | 17.5 | example of present invention |
| 11 | 60 | 510 | — | — | 524 | 614 | 480 | 17.4 | comparison example |
| 12 | 46 | 480 | 500 | 80 | 514 | 583 | 476 | 18.6 | example of present invention |
| 13 | 46 | 540 | 590 | 70 | 514 | 583 | 476 | 18.6 | comparison example |
| 14 | 35 | 450 | 445 | 70 | 523 | 575 | 474 | 25.4 | example of present invention |
| 15 | 35 | 480 | 470 | 80 | 523 | 575 | 474 | 25.4 | comparison example |
| 16 | 45 | 590 | 620 | 70 | 611 | 678 | 509 | 17.5 | comparison example |
| 17 | 35 | 470 | 450 | 80 | 573 | 625 | 486 | 25.4 | example of present invention |

*temperature at position 1 mm away from surface,
*temperature at sheet thickness center portion,
***temperature range from coiling temperature to (coiling temperature −50° C.)
repeat first-stage cooling and second-stage cooling three times for No. 17

TABLE 10

| steel sheet No. | steel No. | kind of steel sheet structure*** position 1 mm away in the sheet thickness direction | primary phase at sheet thickness center position | secondary phase at sheet thickness center position | secondary phase fraction (vol. %) | difference in hardness ΔHV** | tensile characteristics TS (MPa) | low-temperature toughness $vE_{-80}$ (J) |
|---|---|---|---|---|---|---|---|---|
| 1 | A | TM | B | M | 0.1 | 46 | 648 | 268 |
| 2 | A | TM | B | M | 0.2 | 44 | 652 | 254 |
| 3 | A | TM | BF +PF | P | 2.6 | 41 | 641 | 87 |
| 4 | B | TM | B | M | 0.2 | 43 | 665 | 227 |
| 5 | B | TM | B | M | 0.3 | 42 | 676 | 210 |
| 6 | B | TM | B | M | 0.3 | 65 | 672 | 201 |
| 7 | C | TM | B | M | 0.2 | 47 | 689 | 265 |
| 8 | D | TM | B | M | 0.1 | 49 | 677 | 260 |
| 9 | E | TM + B | B | M | 0.3 | 39 | 735 | 254 |
| 10 | F | TM | B | M | 0.2 | 43 | 708 | 249 |
| 11 | F | M | B | M | 0.1 | 70 | 715 | 239 |
| 12 | G | TM | B | M | 0.4 | 45 | 693 | 227 |
| 13 | G | TM | B | M | 2.5 | 43 | 699 | 104 |
| 14 | H | TM | B | M | 0.5 | 47 | 763 | 225 |
| 15 | H | B + TM | B | M | 0.5 | 55 | 763 | 165 |
| 16 | I | BF | BF | P | 0.1 | 13 | 677 | 297 |
| 17 | A | TM | B | M | 0.2 | 45 | 651 | 243 |

| steel sheet No. | low-temperature toughness DWTT ((C.) | low-temperature toughness CTOD value (at −10° C.) (mm) | low-temperature toughness of steel pipe: parent material portion DWTT ((C.) | parent material portion CTOD value (at −10° C.) (mm) | seam portion CTOD value (at −10° C.) (mm) | remarks |
|---|---|---|---|---|---|---|
| 1 | −55 | 0.86 | −30 | 0.85 | 0.75 | example of present invention |
| 2 | −55 | 0.83 | −30 | 0.87 | 0.71 | example of present invention |
| 3 | −25 | 0.41 | 0 | 0.46 | 0.36 | comparison example |
| 4 | −60 | 0.78 | −35 | 0.77 | 0.76 | example of present invention |
| 5 | −50 | 0.71 | −25 | 0.77 | 0.72 | example of present invention |
| 6 | −40 | 0.80 | −15 | 0.78 | 0.76 | comparison example |
| 7 | −60 | 0.74 | −35 | 0.85 | 0.82 | example of present invention |
| 8 | −50 | 0.67 | −25 | 0.66 | 0.66 | example of present invention |
| 9 | −55 | 0.66 | −30 | 0.65 | 0.67 | example of present invention |
| 10 | −55 | 0.66 | −30 | 0.68 | 0.64 | example of present invention |
| 11 | −45 | 0.45 | −20 | 0.46 | 0.38 | comparison example |
| 12 | −60 | 0.95 | −35 | 0.85 | 0.65 | example of present invention |
| 13 | −25 | 0.38 | 0 | 0.32 | 0.37 | comparison example |
| 14 | −50 | 0.79 | −25 | 0.78 | 0.81 | example of present invention |
| 15 | −40 | 0.75 | −15 | 0.69 | 0.66 | comparison example |
| 16 | −60 | 0.86 | −35 | 0.78 | 0.08 | comparison example |
| 17 | −50 | 0.85 | −25 | 0.83 | 0.70 | example of present invention |

*structural difference between position 1 mm away from surface in the sheet thickness direction and sheet thickness center position,
**difference in hardness between position 1 mm away from surface in the sheet thickness direction and sheet thickness center position,
***M: martensite, TM: tempered martensite, B: bainite, BF: bainitic ferrite, P: perlite, PF: polygonal ferrite

The invention claimed is:

1. A high-tensile-strength hot-rolled steel sheet having a composition which contains by mass % 0.02 to 0.08% C, 0.01 to 0.50% Si, 0.5 to 1.8% Mn, 0.025% or less P, 0.005% or less S, 0.005 to 0.10% Al, 0.01 to 0.10% Nb, 0.001 to 0.05% Ti, and Fe and unavoidable impurities as a balance, wherein the steel sheet contains C, Ti and Nb in such a manner that a following formula (1) is satisfied, and the steel sheet has a structure where a primary phase of the structure at a position 1 mm away from a surface of the steel sheet in a sheet thickness direction is one selected from a group consisting of a ferrite phase and a mixture structure of a ferrite phase and tempered martensite, a primary phase of the structure at a sheet thickness center position is formed of a ferrite phase, a difference ΔV between a structural fraction (volume %) of a secondary phase at the position 1 mm away from the surface of the steel sheet in the sheet thickness direction and a structural fraction (volume %) of a secondary phase at the sheet thickness center position is 2% or less, and a difference ΔD between an average grain size of the ferrite phase at the position 1 mm away from the surface of the steel sheet in the sheet thickness direction and an average grain size of the ferrite phase at the sheet thickness center position is 2 μm or less;

wherein (Ti+(Nb/2))/C<4; and

Ti, Nb, C: contents of respective elements (mass %).

2. The high-tensile-strength hot-rolled steel sheet according to claim 1, wherein the structure at the position 1 mm away from the surface in the sheet thickness direction is a structure where the primary phase is formed of the ferrite phase.

3. The high-tensile-strength hot-rolled steel sheet according to claim 2, wherein the average grain size of the ferrite phase at the sheet thickness center position is 5 μm or less, the structural fraction (volume %) of the secondary phase is 2% or less, and a sheet thickness is more than 22 mm.

4. The high-tensile-strength hot-rolled steel sheet according to claim 1, wherein the high-tensile-strength hot-rolled steel sheet has the composition which further contains by mass % one or two kinds or more selected from 0.01 to 0.10% V, 0.01 to 0.50% Mo, 0.01 to 1.0% Cr, 0.01 to 0.50% Cu, and 0.01 to 0.50% Ni in addition to the above-mentioned composition.

5. The high-tensile-strength hot-rolled steel sheet according to claim 1, wherein the high-tensile-strength hot-rolled steel sheet has the composition which further contains by mass % 0.0005 to 0.005% Ca in addition to the above-mentioned composition.

6. A method of manufacturing the high-tensile-strength hot-rolled steel sheet according to claim 2, wherein in manufacturing the hot-rolled steel sheet by heating a steel material having the composition according to claim 2 and by applying hot rolling constituted of rough rolling and finish rolling to the steel material, the accelerated cooling is constituted of primary accelerated cooling and secondary accelerated cooling, wherein the primary accelerated cooling is performed in such a manner that cooling in which an average cooling rate at the sheet thickness center position is 10° C./s or more and a cooling rate difference between an average cooling rate at a sheet thickness center position and an average cooling rate at a position 1 mm away from a surface in a sheet thickness direction is less than 80° C./s is performed until a primary cooling stop temperature by which a temperature at a position 1 mm away from the surface in the sheet thickness direction becomes a temperature in a temperature range of 650° C. or below and 500° C. or above is obtained, and the secondary accelerated cooling is performed in such a manner that cooling in which the average cooling rate at the sheet thickness center position is 10° C./s or more, and the cooling rate difference between the average cooling rate at the sheet thickness center position and the average cooling rate at the position 1 mm away from the surface in the sheet thickness direction is 80° C./s or more is performed until the temperature at the sheet thickness center position becomes a secondary cooling stop temperature of BFS which is defined by a following formula (2) or below, and a hot-rolled steel sheet is coiled at a coiling temperature of BFS0 which is defined by a following formula (3) or below as the temperature at the sheet thickness center position after the secondary accelerated cooling, wherein BFS(° C.)=770−300C−70Mn−70Cr−170Mo−40Cu−40Ni−1.5CR, BFS0(° C.)=770−300C−70Mn−70Cr−170Mo−40Cu−40Ni, C, Mn, Cr, Mo, Cu, Ni: contents of respective elements (mass %), and CR: cooling rate (° C./s).

7. The method of manufacturing the high-tensile-strength hot-rolled steel sheet according to claim 6, wherein air cooling is performed for 10 s or less between the primary accelerated cooling and the secondary accelerated cooling.

8. The method of manufacturing the high-tensile-strength hot-rolled steel sheet according to claim 6, wherein the accelerated cooling is performed at the average cooling rate of 10° C./s or more in the temperature range of 750 to 650° C. at the sheet thickness center position.

9. The method of manufacturing the high-tensile-strength hot-rolled steel sheet according to claim 6, wherein the difference between the cooling stop temperature at the position 1 mm away from the surface in the sheet thickness direction and the coiling temperature in the second accelerated cooling falls within 300° C.

10. The method of manufacturing the high-tensile-strength hot-rolled steel sheet according to claim 6, wherein the hot-rolled steel sheet has the composition which further contains by mass % one or two kinds or more selected from 0.01 to 0.10% V, 0.01 to 0.50% Mo, 0.01 to 1.0% Cr, 0.01 to 0.50% Cu, and 0.01 to 0.50% Ni in addition to the composition.

11. The method of manufacturing the high-tensile-strength hot-rolled steel sheet according to claim 6, wherein the hot-rolled steel sheet has the composition which further contains by mass % 0.0005 to 0.005% Ca in addition to the composition.

12. A method of manufacturing the high-tensile-strength hot-rolled steel sheet having a sheet thickness exceeding 22 mm according to claim 3 and, wherein a hot-rolled steel sheet is manufactured by heating a steel material having the composition according to claim 3 and by applying hot rolling constituted of rough rolling and finish rolling to the steel material and, subsequently, accelerated cooling is applied to the hot-rolled steel sheet after completing the finish rolling at 10° C./s or more in terms of an average cooling rate at a sheet thickness center position until a cooling stop temperature of BFS defined by the following formula (2) or below is obtained, and in coiling the hot-rolled steel sheet at a coiling temperature of BFSO defined by a following formula (3) or below, a temperature of the hot-rolled steel sheet at the sheet thickness center position is adjusted in such a manner that a holding time through which a temperature of the hot-rolled steel sheet at the sheet thickness center position reaches a temperature (T−20° C.) from a temperature T(° C.) which is a temperature at the time of starting the accelerated cooling is set to 20 s or less, and a cooling time from the temperature T to the temperature of BFS at the sheet thickness center position is set to 30 s or less, wherein BFS(° C.)=770−300C−70Mn−70Cr−170Mo−40Cu−40Ni−1.5CR, BFS0(° C.)=770−300C−70Mn−70Cr−170Mo−40Cu−40Ni, C, Mn, Cr, Mo, Cu, Ni: contents of respective elements (mass %), and CR: cooling rate (° C./s).

13. The method of manufacturing the high-tensile-strength hot-rolled steel sheet according to claim 12, wherein the hot-rolled steel sheet has the composition which further contains by mass % one or two or more kinds selected from 0.01 to 0.10% V, 0.01 to 0.50% Mo, 0.01 to 1.0% Cr, 0.01 to 0.50% Cu, and 0.01 to 0.50% Ni in addition to the above-mentioned composition.

14. The method of manufacturing the high-tensile-strength hot-rolled steel sheet according to claim 12, wherein the hot-rolled steel sheet has the composition which further contains by mass % 0.0005 to 0.005% Ca in addition to the composition.

15. The high-tensile-strength hot-rolled steel sheet according to claim 1, wherein the secondary phase is formed of any one of martensite and MA or the mixture of these phases.

16. The high-tensile-strength hot-rolled steel sheet according to claim 1, wherein $\Delta V$ is 0.1 to 2% and $\Delta D$ is 0.1 to 2 μm.

17. The high-tensile-strength hot-rolled steel sheet according to claim 4, wherein the high-tensile-strength hot-rolled steel sheet has the composition which further contains by mass % 0.0005 to 0.005% Ca in addition to the above-mentioned composition.

18. The method of manufacturing the high-tensile-strength hot-rolled steel sheet according to claim 10, wherein the hot-rolled steel sheet has the composition which further contains by mass % 0.0005 to 0.005% Ca in addition to the composition.

19. The method of manufacturing the high-tensile-strength hot-rolled steel sheet according to claim 13, wherein the hot-rolled steel sheet has the composition which further contains by mass % 0.0005 to 0.005% Ca in addition to the composition.

* * * * *